US007540595B2

(12) United States Patent
Kodama

(10) Patent No.: US 7,540,595 B2
(45) Date of Patent: Jun. 2, 2009

(54) LIQUID EJECTION HEAD

(75) Inventor: Kenichi Kodama, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 480 days.

(21) Appl. No.: 11/390,136

(22) Filed: Mar. 28, 2006

(65) Prior Publication Data

US 2006/0221143 A1 Oct. 5, 2006

(30) Foreign Application Priority Data

Mar. 29, 2005 (JP) ..... 2005-094357

(51) Int. Cl.
*B41J 2/045* (2006.01)

(52) U.S. Cl. ..... 347/70

(58) Field of Classification Search ..... 347/70
See application file for complete search history.

(56) References Cited

FOREIGN PATENT DOCUMENTS

JP 10-217465 A 8/1998
JP 11-99666 A 4/1999
JP 11314363 A * 11/1999
JP 2003-136690 A 5/2003
* cited by examiner

*Primary Examiner*—Matthew Luu
*Assistant Examiner*—Lisa M Solomon
(74) *Attorney, Agent, or Firm*—Birch, Stewart, Kolasch & Birch, LLP

(57) ABSTRACT

The liquid ejection head comprises: a pressure chamber which accommodates liquid to be ejected through an ejection aperture; a diaphragm which constitutes a wall of the pressure chamber; a supply port which is formed as an opening section in a portion of the diaphragm; a supply flow channel which is provided between the supply port and the pressure chamber; and a common liquid chamber which accommodates the liquid to be supplied to the pressure chamber through the supply port and the supply flow channel and is arranged on a side of the diaphragm reverse to a side thereof adjacent to the pressure chamber, wherein the diaphragm has a tongue section, a portion of a perimeter of the tongue section being surrounded by the supply port, the tongue section constituting a portion of a wall of the supply flow channel, a portion of the diaphragm forming the tongue section having a laminated structure of an upper layer on the side adjacent to the common liquid chamber and a lower layer on the side adjacent to the pressure chamber, a coefficient of linear expansion $\alpha 1$ of the upper layer and a coefficient of linear expansion $\alpha 2$ of the lower layer satisfying a relationship of $\alpha 1 < \alpha 2$, at least a portion of the tongue section being bendable in a direction to change a size of the supply flow channel.

6 Claims, 16 Drawing Sheets

FIG.10

| | | | |
|---|---|---|---|
| METAL (UPPER LAYER) | COEFFICIENT OF LINEAR EXPANSION | $\alpha 1$ | $1.50\times10^{-5}$(1/K) |
| | THICKNESS | t1 | $1.00\times10^{-5}$(m) |
| | ELASTICITY COEFFICIENT | E1 | $2.00\times10^{11}$(Pa) |

| | | | |
|---|---|---|---|
| RESIN (LOWER LAYER) | COEFFICIENT OF LINEAR EXPANSION | $\alpha 2$ | $1.00\times10^{-4}$(1/K) |
| | THICKNESS | t2 | $3.00\times10^{-5}$(m) |
| | ELASTICITY COEFFICIENT | E2 | $3.00\times10^{9}$(Pa) |

| | | |
|---|---|---|
| LENGTH | L | $6.00\times10^{-4}$(m) |

LIQUID EJECTION HEAD

BACKGROUND OF THE INVENTION

1. Field of the Invention

The present invention relates to a liquid ejection head, and more particularly, to liquid ejection technology for a liquid ejection apparatus and head, which suppresses change in ejection characteristics due to change in the liquid temperature.

2. Description of the Related Art

An inkjet recording apparatus is known, which comprises an inkjet head (liquid ejection head) having an arrangement of a plurality of nozzles and which records images on a recording medium by ejecting ink from the nozzles toward the recording medium while causing the inkjet head and the recording medium to move relatively to each other.

In the inkjet recording apparatus, ink is supplied to pressure chambers from an ink tank, through an ink supply channel, and by driving actuators by supplying electrical signals corresponding to the image data to the actuators, the pressure chambers are caused to deform, thereby reducing the volume of the pressure chambers and causing the ink inside the pressure chambers to be ejected from the nozzles in the form of droplets. In the inkjet recording apparatus, a desired image is formed on a recording medium by combining dots formed by ink ejected from the nozzles.

In recent years, it has become desirable to form images of high quality on a par with photographic prints, in inkjet recording apparatuses. In response to this, the dots can be made finer and image resolution can be increased by reducing the size of the ink droplets ejected from the nozzles by reducing the nozzle diameter, and furthermore, increased resolution of the dots and improved quality of the image formed on the recording medium can be achieved by increasing the number of pixels per image by arranging the nozzles at high density. As a method of increasing the density of the nozzle arrangement, it has been proposed that nozzles be arranged in a two-dimensional matrix array.

It is generally known that, when the temperature of the inkjet head (the temperature of the ink in the inkjet head) changes, then the viscosity of the ink changes and the ink ejection characteristics vary. For example, the ink viscosity falls when the ink temperature rises, and the ink viscosity rises when the ink temperature falls. If the ink viscosity rises, then the volume of ink ejected when a prescribed pressure is applied becomes smaller than the prescribed ejection volume, and the speed of flight of the ink droplet is smaller than the prescribed speed of flight. The following methods have been proposed in order to achieve stable ink ejection, even if there is a change of this kind in the ink temperature.

One method of resolving the aforementioned problem is to measure the temperature of the ink (inkjet head) and to implement control whereby the ink temperature remains uniform. More specifically, there is a method in which the temperature is controlled by using special temperature control elements, or a method in which the actuators are caused to vibrate to generate heat used to control the temperature. On the other hand, a method is also proposed in which the drive waveform applied to the actuators is controlled on the basis of the measured temperature. More specifically, proposed methods include: a method which changes the ejection force generated by the actuators by varying the voltage of the drive waveform; a method which changes the frequency of the drive waveform (drive frequency) (Japanese Patent Application Publication No. 10-217465); a method which raises the temperature of the ink by driving the actuators at a high frequency (Japanese Patent Application Publication No. 11-99666); a method which varies the ejection timing; and the like. Furthermore, a method has been proposed in which a plurality of the methods described above are combined together and when the ink temperature is measured, the drive waveform of the energy generating members is controlled by heating and controlling the ink (Japanese Patent Application Publication No. 2003-136690).

However, in the methods described in Japanese Patent Application Publication Nos. 10-217465, 11-99666 and 2003-136690, and the like, temperature measurement elements to measure the ink temperature, and a control circuit for temperature measurement, are required. Furthermore, in a method in which the ink temperature is controlled so as to be uniform, then it is necessary to provide temperature control elements for controlling the temperature, and a control circuit and control system for driving these temperature control elements. In a method in which the drive waveform is controlled, a circuit or control system for altering the drive waveform is required. If a control circuit or control system of this kind is used, then not only do the head structure and the circuit composition become more complicated, but also, there is a probability of increasing the load on the control system of the head.

SUMMARY OF THE INVENTION

The present invention has been contrived in view of these circumstances, an object thereof being to provide a liquid ejection head capable of achieving prescribed ejection characteristics which are stable even when the ink temperature changes, without using complicated control circuits or control procedures.

In order to attain the aforementioned object, the present invention is directed to a liquid ejection head, comprising: a pressure chamber which accommodates liquid to be ejected through an ejection aperture; a diaphragm which constitutes a wall of the pressure chamber; a supply port which is formed as an opening section in a portion of the diaphragm; a supply flow channel which is provided between the supply port and the pressure chamber; and a common liquid chamber which accommodates the liquid to be supplied to the pressure chamber through the supply port and the supply flow channel and is arranged on a side of the diaphragm reverse to a side thereof adjacent to the pressure chamber, wherein the diaphragm has a tongue section, a portion of a perimeter of the tongue section being surrounded by the supply port, the tongue section constituting a portion of a wall of the supply flow channel, a portion of the diaphragm forming the tongue section having a laminated structure of an upper layer on the side adjacent to the common liquid chamber and a lower layer on the side adjacent to the pressure chamber, a coefficient of linear expansion $\alpha 1$ of the upper layer and a coefficient of linear expansion $\alpha 2$ of the lower layer satisfying a relationship of $\alpha 1<\alpha 2$, at least a portion of the tongue section being bendable in a direction to change a size of the supply flow channel.

According to the present invention, the tongue section constitutes a portion of the walls of the supply flow channel and is disposed in such a manner that a portion of the perimeter thereof is surrounded by the supply port formed as an opening in a portion of the diaphragm, and since the tongue section has the laminated structure in which two layer having different coefficients of linear expansion are bonded together, and since the coefficient of linear expansion $\alpha 1$ (1/K) of the upper layer on the side adjacent to the common liquid chamber and the coefficient of linear expansion $\alpha 2$ (1/K) of the lower layer on the side adjacent to the pressure chamber satisfy the relationship of $\alpha 1<\alpha 2$, then the size of the supply flow channel is altered by the deformation of the tongue section due to bimetal-like effect (through the upper and lower layers are not necessarily formed of metal), when the temperature of the liquid changes. Therefore, even if the viscosity of the liquid varies due to change in the temperature of the liquid, since the size of the supply flow channel changes, then it is possible to maintain uniform ejection characteristics when the liquid is ejected from the nozzle.

For example, when the temperature of the liquid rises, the supply flow channel becomes larger by deformation of the tongue section, so that the liquid becomes less liable to be ejected from the nozzles (in other words, the liquid flows more readily from the pressure chamber to the liquid flow channel side than to the nozzle side, during ejection), thereby canceling out the fact that the liquid becomes more liable to be ejected from the nozzles when the viscosity of the liquid falls as a result of a rise in the temperature of the liquid. On the other hand, when the temperature of the liquid falls, the size of the supply flow channel is reduced by deformation of the tongue section, so that the liquid becomes more liable to be ejected from the nozzles, thereby canceling out the fact that the liquid becomes less liable to be ejected from the nozzles when the viscosity of the liquid rises as a result of a fall in the temperature of the liquid. In this way, it is possible to keep the ejection characteristics uniform when ejecting liquid from the nozzles.

A metal material, such as stainless steel, is suitable for the upper layer, and a resin material, such as polyimide, is suitable for the lower layer. When material which does not have liquid resistant properties is used for the upper layer and lower layer (and in particular, the surfaces or sections which make contact with the liquid), then a protective film is formed on the liquid contacting sections which make contact with the liquid.

Preferably, the diaphragm has a laminated structure of an upper layer on the side adjacent to the common liquid chamber having the coefficient of linear expansion $\alpha 1$ and a lower layer on the side adjacent to the pressure chamber having the coefficient of linear expansion $\alpha 2$.

According to this aspect of the present invention, since the diaphragm is formed by the two layers having different coefficients of linear expansion, in other words, the layer on the side adjacent to the common liquid chamber having the coefficient of linear expansion $\alpha 1$ and the layer on the side adjacent to the pressure chamber having the coefficient of linear expansion $\alpha 2$, where the relationship $\alpha 1<\alpha 2$ is satisfied (i.e., the diaphragm and the tongue section have substantially the same laminated structure), the process of forming the diaphragm is also used for forming the tongue section, thereby the manufacturing process of the liquid ejection head can be simplified.

There is a mode in which an actuator for changing the volume of the pressure chamber by causing the diaphragm to deform is provided on the opposite side of the diaphragm from the pressure chamber (in other words, on the upper layer adjacent to the common liquid chamber), and in this case, a metal material, such as stainless steel, is preferably used for the upper layer so that the upper layer can also serve as a common electrode for the actuator (forming a reference potential for the drive signal supplied to the actuator, and a common reference potential for the actuators, if a plurality of actuators are provided).

A protective film (protective layer) having liquid resistant properties is formed on the liquid-contacting section of the tongue section which makes contact with the liquid. For example, if a metal material is used for the upper layer of the tongue section, then a prescribed protective film (insulating film) is formed on at least the liquid-contacting section of the upper layer.

Preferably, the supply port has a substantially horseshoe-shaped planar form when observed from the side of the common liquid chamber.

By forming the planar shape of the supply port as a horseshoe shape (an approximate square U-shape), the tongue section whose perimeter is partially surrounded by the supply port is able to deform more readily due to a bimetal-like effect, and hence increased sensitivity with respect to temperature change can be expected.

Preferably, the coefficient of linear expansion $\alpha 1$ of the upper layer and the coefficient of linear expansion $\alpha 2$ of the lower layer satisfy a relationship of $\alpha 2/\alpha 1>6$. According to this, it is possible to maintain stable ejection characteristics, regardless of temperature change in the liquid.

Preferably, a thickness t1 of the upper layer and a thickness t2 of the lower layer satisfy a relationship of $t1 \geqq t2$; and an elasticity coefficient E1 of the upper layer and an elasticity coefficient E2 of the lower layer satisfy a relationship of $E1 \leqq E2$.

According to this aspect of the present invention, when the thickness t1 of the upper layer is equal to or larger than the thickness t2 of the lower layer, materials for the upper layer and the lower layer are selected in such a manner that the elasticity coefficient E1 of the upper layer is equal to or lower than the elasticity coefficient E2 of the lower layer, and it is thereby possible to ensure a prescribed amount of displacement of the tongue section with respect to a prescribed temperature change by selecting.

Alternatively, it is also preferable that a thickness t1 of the upper layer and a thickness t2 of the lower layer satisfy a relationship of $t1<t2$; and an elasticity coefficient E1 of the upper layer and an elasticity coefficient E2 of the lower layer satisfy a relationship of $E1>E2$.

According to this aspect of the present invention, when the thickness t1 of the upper layer is smaller than the thickness t2 of the lower layer, materials for the upper layer and the lower layer are selected in such a manner that the elasticity coefficient E1 of the upper layer is higher than the elasticity coefficient E2 of the lower layer, and it is thereby possible to ensure a prescribed amount of displacement of the tongue section with respect to a prescribed temperature change by selecting.

According to the present invention, a composition is adopted in which the size of the supply flow channel is varied when the temperature of the liquid changes, by deformation of the tongue section, which constitutes a portion of the walls of the supply flow channel and has a laminated structure of two layers having different coefficients of linear expansion, by the bimetal-like effect due to the change in the ink temperature. Therefore, variations in ejection characteristics caused by change in the viscosity of the liquid due to change in the temperature of the liquid are cancelled out by alteration of the size of the supply flow channel, and hence prescribed ejection characteristics can be ensured, even if the temperature of the liquid changes.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 10 is a table showing an embodiment of the coefficients of linear expansion, thicknesses and elasticity coefficients, of an upper layer and a lower layer of a tongue section;

DETAILED DESCRIPTION OF THE PREFERRED EMBODIMENTS

Figure 1:
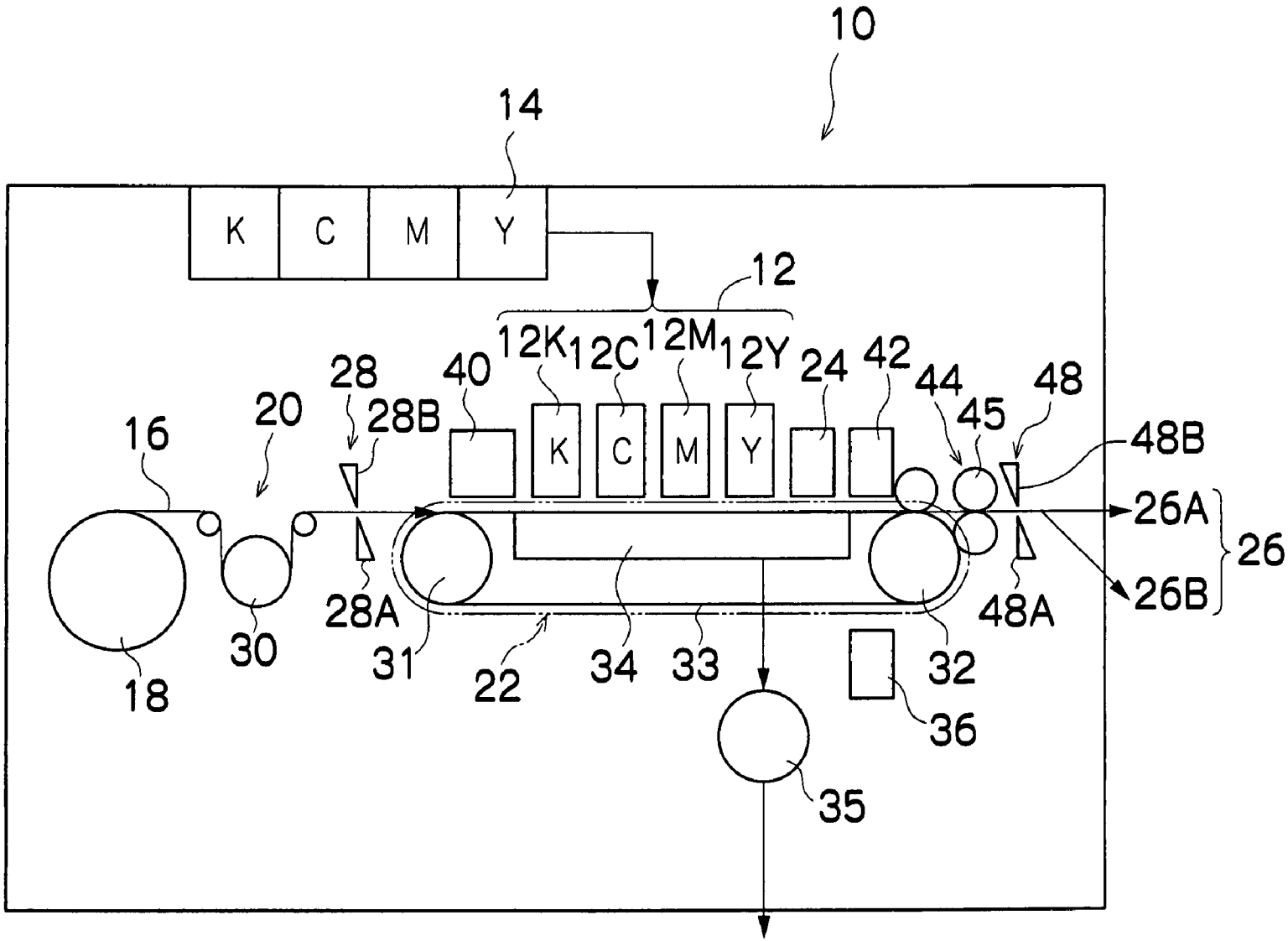
FIG. 1 is a general schematic drawing of an inkjet recording apparatus according to an embodiment of the present invention.

Below, an inkjet recording apparatus having a liquid ejection head according to the present invention is described in detail, with reference to the accompanying drawings. FIG. 1 is a schematic drawing showing a general view of the inkjet recording apparatus 10.

As shown in FIG. 1, the inkjet recording apparatus 10 comprises: a printing unit 12 having a plurality of print heads (liquid ejection heads) 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16 supplied from the paper supply unit 18; a suction belt conveyance unit 22 disposed facing the nozzle face (ink droplet ejection face) of the print unit 12, for conveying the recording paper 16 while keeping the recording paper 16 flat; a print determination unit 24 for reading the printed result produced by the printing unit 12; and a paper output unit 26 for outputting printed recording paper (printed matter) to the exterior.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print heads 12K, 12C, 12M, and 12Y of the printing unit 12 and the sensor face of the print determination unit 24 forms a plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (not shown in FIG. 1, but shown in FIG. 8) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
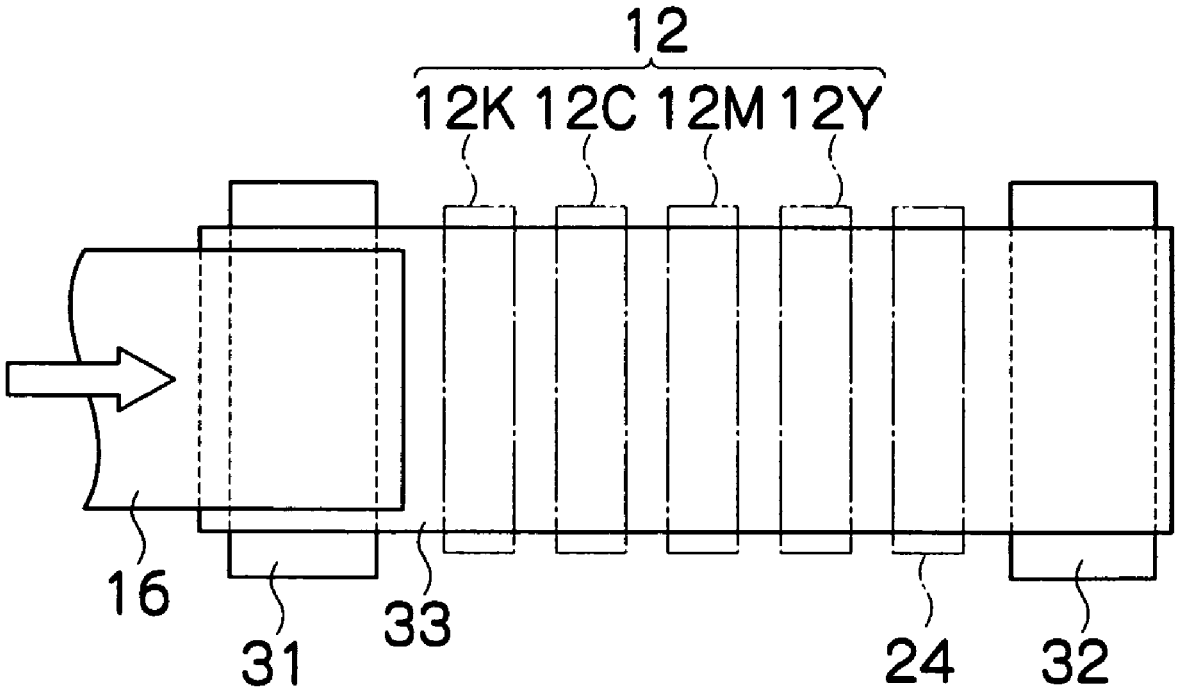
FIG. 2 is a principal plan diagram of the peripheral area of a print unit in the inkjet recording apparatus shown in FIG. 1.

The print unit 12 is a so-called "full line head" in which a line head having a length corresponding to the maximum paper width is arranged in a direction (main scanning direction) that is perpendicular to the paper conveyance direction (sub-scanning direction) (see FIG. 2).

As shown in FIG. 2, the print heads 12K, 12C, 12M and 12Y are constituted by line heads in which a plurality of nozzles are arranged through a length exceeding at least one edge of the maximum size recording paper 16 intended for use with the inkjet recording apparatus 10.

The print heads 12K, 12C, 12M, 12Y corresponding to respective ink colors are disposed in the order, black (K), cyan (C), magenta (M) and yellow (Y), from the upstream side (left-hand side in FIG. 1), following the direction of conveyance of the recording paper 16 (the paper feed direction). A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in a direction substantially perpendicular to the paper conveyance direction (main scanning direction).

Here, the terms main scanning direction and sub-scanning direction are used in the following senses. More specifically, in a full-line head comprising rows of nozzles that have a length corresponding to the entire width of the recording paper, "main scanning" is defined as printing one line (a line formed of a row of dots, or a line formed of a plurality of rows of dots) in the breadthways direction of the recording paper (the direction perpendicular to the paper feed direction) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action is called the "main scanning direction".

On the other hand, "sub-scanning" is defined as to repeatedly perform printing of one line (a line formed of a row of dots, or a line formed of a plurality of rows of dots) formed by the main scanning action, while moving the full-line head and the recording paper relatively to each other. The direction in which sub-scanning is performed is called the sub-scanning direction. Consequently, the paper feed direction is the sub-scanning direction, and the direction substantially perpendicular to the sub-scanning direction is the main scanning direction.

Although the configuration with the KCMY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device, an alarm sound generator, or the like) for warning when the remaining amount of any ink is low, and has a mechanism for preventing loading errors among the colors.

The print determination unit 24 has an image sensor (line sensor or the like) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown, the paper output unit 26A for the target prints is provided with a sorter for collecting prints according to print orders.

Figure 3A:
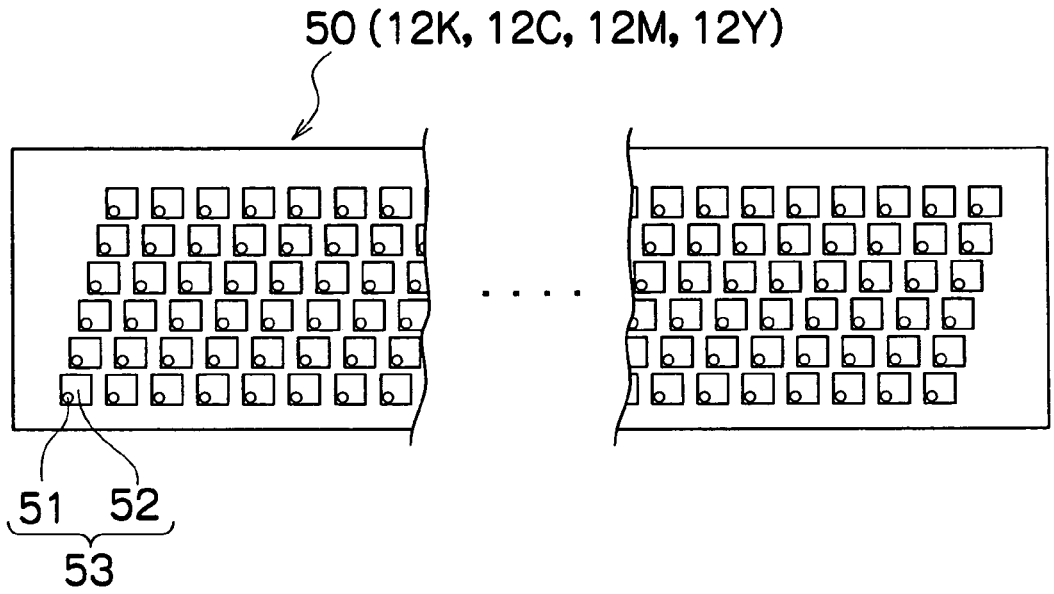
FIGS. 3A and 3B are plan view perspective diagrams showing examples of the composition of a print head.

Next, the arrangement of the nozzles in the print heads 12K, 12C, 12M and 12Y is described. The print heads 12K, 12C, 12M and 12Y provided for the respective ink colors each have the same structure, and a print head forming a representative embodiment of these print heads is denoted with the reference numeral 50. FIG. 3A shows a plan view perspective diagram of the print head 50.

As shown in FIG. 3A, the print head 50 according to the present embodiment achieves a high density arrangement of nozzles 51 by using a two-dimensional staggered matrix array of pressure chamber units 53, each constituted by a nozzle for ejecting ink in the form of ink droplets, a pressure chamber 52 for applying pressure to the ink in order to eject ink, and a supply port (not shown in FIG. 3A, and indicated by reference numeral 54 in FIG. 4) for supplying ink to the pressure chamber 52 from a common flow channel (not shown in FIG. 3A).

There are no particular limitations on the size of the nozzle arrangement in the print head 50 of this kind, and for example, 2,400 nozzles per inch (npi) can be achieved by arranging the nozzles 51 in 48 lateral rows (in 21 mm) and 600 vertical columns (in 305 mm).

In the embodiment shown in FIG. 3A, the pressure chambers 52 each have an approximately square planar shape when viewed from above, but the planar shape of the pressure chambers 52 is not limited to a square shape. A nozzle 51 is formed at one end of the diagonal of each pressure chamber 52, as shown in FIG. 3A.

Figure 3B:
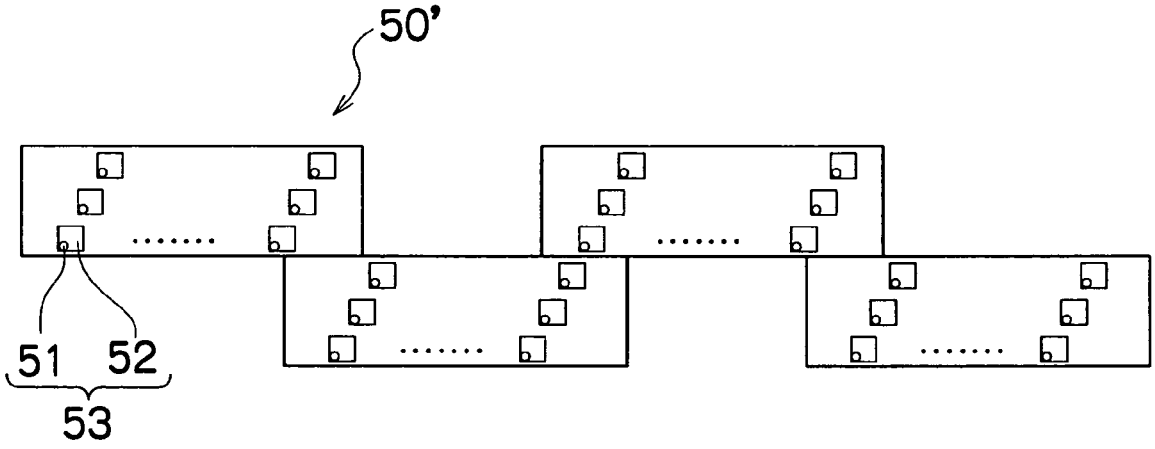

Moreover, FIG. 3B is a plan view perspective diagram showing a further embodiment of the structure of a print head. As shown in FIG. 3B, one long full line head may be constituted by combining a plurality of short heads 50' arranged in a two-dimensional staggered array, in such a manner that the combined length of this plurality of short heads 50' corresponds to the full width of the print medium.

Next, a detailed description is given of the structure of the print head 50 having the characteristic feature of the present invention in that it is able to drive ejection at high frequency and to eject ink of high viscosity, even when the nozzles, the ink supply system and the wiring supplying the drive signals are arranged at high density.

Figure 4:
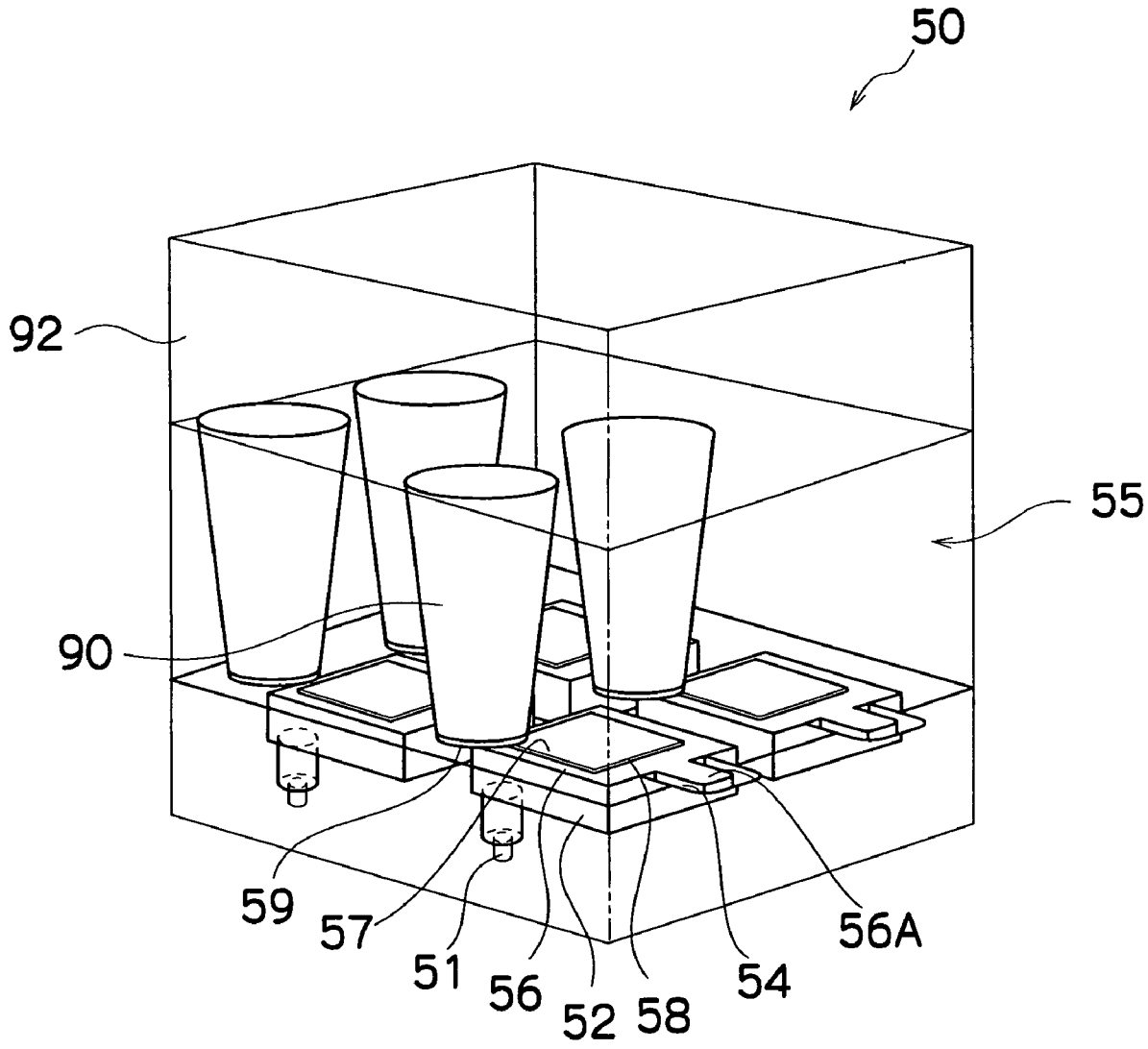
FIG. 4 is an oblique perspective diagram showing an enlarged view of a portion of the print head.

In the present embodiment, in order to achieve high density in the print head 50, a high-density arrangement of nozzles 51 is obtained (for example, 2,400 npi) by arranging the pressure chambers 52 (the nozzles 51) in the form of a two-dimensional matrix, as shown in FIG. 3A, for example. Furthermore, as shown in FIG. 4, the ink supply system is integrated to a high degree, by disposing a common liquid chamber 55 for supplying ink to the pressure chambers 52 on the upper side of a diaphragm 56 reverse to the side thereof adjacent to the pressure chambers 52, in such a manner that the ink is supplied directly to the pressure chambers 52 from the common liquid chamber 55 through supply ports 54 formed on the diaphragm 56, in order to prioritize ink refilling properties, and thus dispensing with tubing channels which create a flow channel resistance (in other words, the flow channel resistance of the ink flow channels on the supply side, which supply ink to the pressure chambers 52, is reduced). Furthermore, in the present embodiment, the electrical wires 90 rise upward perpendicularly from the individual electrodes 57, pass through the common liquid chamber 55 and are connected to an upper wiring member, such as a flexible printed circuit 92, so that drive signals are supplied through the wiring to the electrodes (individual electrodes 57) of actuators 58 that deform the pressure chambers 52.

FIG. 4 shows a simplified oblique perspective view of a portion of the print head 50 formed to a high density in this way.

As shown in FIG. 4, in the print head 50 according to the present embodiment, the pressure chambers 52 each have the nozzles 51, and the diaphragm 56 forming the upper surface of the pressure chambers 52 disposed on the upper side (the opposite side to the direction of ink ejection) of the pressure chambers 52. The actuator 58 constituted by a piezoelectric element provided with the upper and lower electrodes is disposed in each of positions on the diaphragm 56 corresponding to the pressure chambers 52. The individual electrode 57 is arranged on the upper surface of each actuator 58, on the opposite side from the diaphragm 56.

An electrode pad 59 forming an electrode connecting section extends from the end section of each individual electrode 57 (in FIG. 4, the end section corresponding to the position where the nozzle 51 is formed), to the region where the actuator 58 is not provided, and the electrical wire 90 is formed so as to rise upward on the electrode pad 59 substantially perpendicularly to the surface bearing the actuators 58 (the actuator installation surface). The multiple-layer flexible printed circuit 92 is disposed on top of the electrical wires 90, which rise up substantially perpendicularly with respect to the actuator installation surface, in such a manner that drive signals are supplied through the electrical wires 90 to the individual electrodes 57 of the actuators 58, from a drive signal generating unit (not shown in FIG. 4 and represented by head driver 84 in FIG. 8).

The space in which the column-shaped electrical wires 90 are erected between the diaphragm 56 and the flexible printed circuit 92 is used as the common liquid chamber 55 for supplying ink to the pressure chambers 52 through the ink supply ports 54.

The common liquid chamber 55 shown here is one large space formed throughout the whole region where the pressure chambers 52 are formed, in such a manner that the common liquid chamber 55 supplies ink to all of the pressure chambers 52 shown in FIG. 3A; however, the common liquid chamber 55 is not limited to being formed into one space, and a plurality of chambers may be formed by dividing up the space into several regions.

The electrical wires 90, which rise up perpendicularly like columns on top of the electrode pads 59 provided to connect to the individual electrodes 57 for the pressure chambers 52, support the flexible printed circuit 92 from below, thus creating the space for the common liquid chamber 55. The electrical wires 90 rising up like columns in this way may also be called "electric columns", due to their shape. In other words, the electrical wires 90 (electrical columns) are formed so as to pass through the common liquid chamber 55.

The electrical wires 90 shown here are formed independently with respect to the actuators 58 (or the individual electrodes 57 thereof), in a one-to-one correspondence, but in order to reduce the number of wires (the number of electrical columns), it is also possible to make one electrical wire 90 correspond to a plurality of actuators 58, in such a manner that the wires corresponding to several actuators 58 are gathered together and formed into one electrical wire 90. The wiring to the common electrodes (the diaphragm 56) may also be formed as the electrical wires 90, in addition to that connected to the individual electrodes 57. Furthermore, the electrical wires 90 may send signals (for example, measurement signals obtained from sensors, or the like) other than drive signals to be supplied to the actuators 58.

The supply ports 54 shown in the present embodiment are formed so as to pass through the diaphragm 56 in the regions where the actuators 58 (the individual electrodes 57) are not installed, and the common liquid chamber 55 located above the diaphragm 56 is connected directly to the pressure chambers 52 through the supply ports 54. Consequently, it is possible to form a direct fluid connection between the common liquid chamber 55 and each of the pressure chambers 52.

As shown in FIG. 4, the supply ports 54 have a horseshoe-shaped (approximately square U-shaped) planar form (namely, the planar form of the opening section), when viewed from the side of the common liquid chamber 55 (in the direction of ink ejection).

The diaphragm 56 is common to all of the pressure chambers 52 and is formed as a plate having a two-layer structure. The actuators 58 for deforming the pressure chambers 52 are disposed on the diaphragm 56 in the positions corresponding to the pressure chambers 52. The electrodes (the common electrode and the individual electrode) for driving each actuator 58 by applying a voltage to same are formed on the upper and lower surfaces of each actuator 58, thereby sandwiching the actuator 58. For the actuators 58, it is possible to use a split electrode type of piezoelectric element, which is constituted by an integrated piezoelectric body that is common to the pressure chambers 52, similarly to the diaphragm 56, and the individual electrodes 57 being provided so as to respectively correspond to the pressure chambers 52.

The upper layer 56B (shown in FIG. 9A), on which the actuators 58 are arranged, of the two layers constituting the diaphragm 56 can be made of a conductive material, such as stainless steel for example, so that the diaphragm 56 also serves as the common electrode. In this case, the individual electrode 57 for driving the actuator 58 independently is provided on the upper surface of each of the actuators 58. On the other hand, the lower layer 56C (shown in FIG. 9A) on the side adjacent to the pressure chambers 52 of the two layers constituting the diaphragm 56 is made of a material having a higher coefficient of linear expansion compared to the upper layer 56B. The detailed structure of the diaphragm 56 is described later.

The electrode pads 59 are formed to extend from the individual electrodes 57, and the electrical wires (electrical columns) 90, which pass through the common liquid chamber 55, are formed rising up perpendicularly from the electrode pads 59. The method of manufacturing the electrical wires (electrical columns) 90 is described later, and in this manufacturing step, the electrical wires 90 are formed in a tapered shape, as shown in FIG. 4 (namely, a structure in which the width of the bonding sections with the electrode pads 59 is narrower than the width of the bonding sections with the flexible printed circuit 92, and the electrical wires 90 become gradually thinner from the bonding sections with the flexible printed circuit 92 toward the bonding sections with the electrode pads 59).

The multi-layer flexible printed circuit 92 is formed on top of the column-shaped electrical wires 90, in such a manner that the multi-layer flexible printed circuit 92 is supported by the columns formed by the electrical wires 90, and the space for forming the common liquid chamber 55 is ensured by taking the diaphragm 56 as the floor (bottom face), and the multi-layer flexible printed circuit 92 as the ceiling (upper face). Although not shown in the drawings, the individual electrodes 57 are connected independently to the electrical wires 90, in such a manner that drive signals are supplied respectively to the individual electrodes 57, thereby driving the actuators 58.

Furthermore, although not shown in FIG. 4, since the common liquid chamber 55 is filled with ink, the surfaces of the diaphragm 56 (of which a portion forms the common electrode), the individual electrodes 57, the electrical wires 90 and the multi-layer flexible printed circuit 92, that make contact with the ink are covered with an insulating protective film.

There are no particular restrictions on the size of the print head 50 described above, but to give one embodiment, the planar shape of the pressure chambers 52 is an approximately square shape of 300 μm×300 μm (the corners thereof being curved in order to prevent stagnation points in the ink flow), the height of the pressure chambers is 150 μm, the diaphragm 56 and the actuators 58 each have a thickness of 10 μm, the electrical wires (electrical columns) 90 have a height of 500 μm and a diameter of 100 μm at the bonding section with the electrode pad 59.

Figure 5:
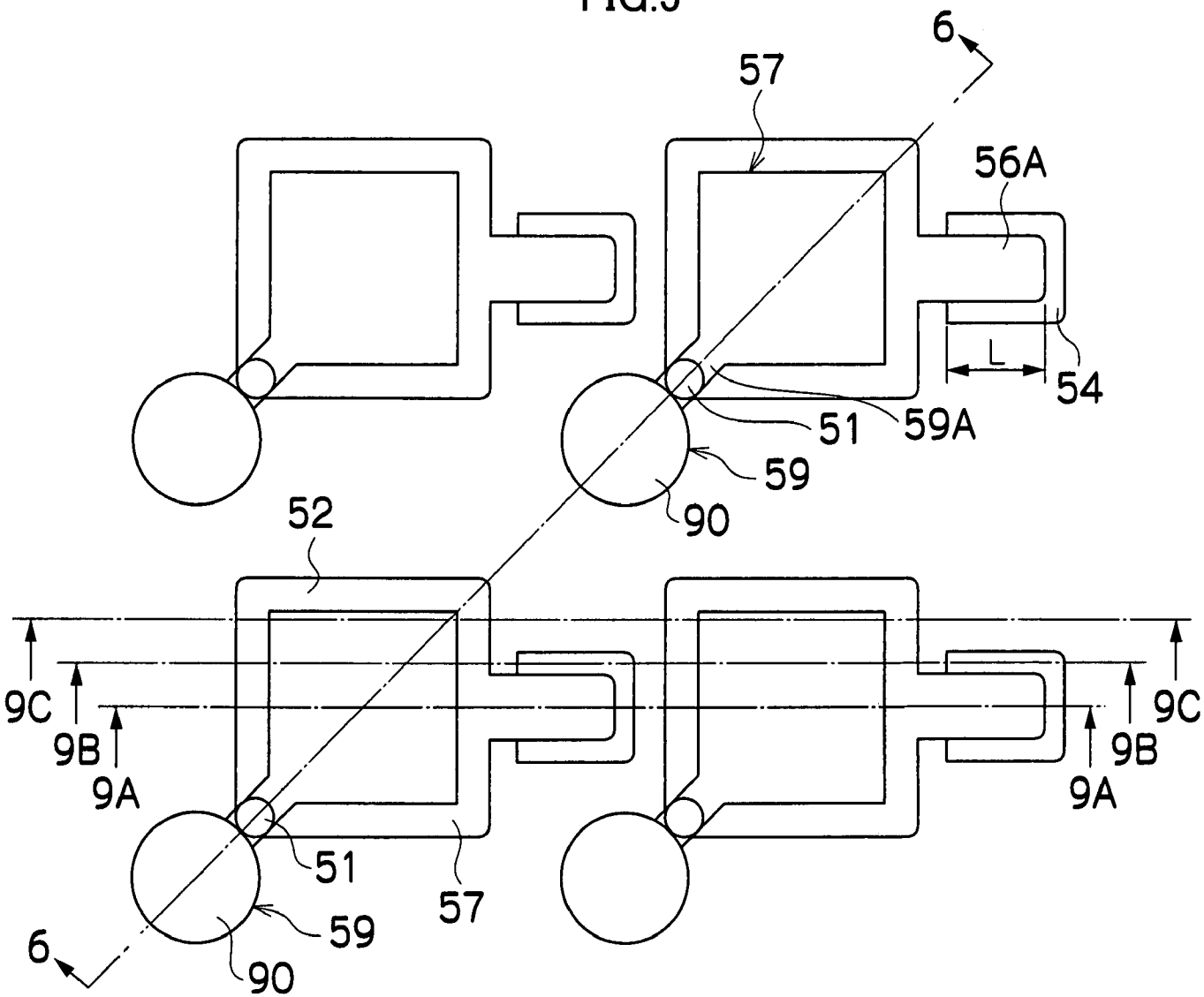
FIG. 5 is an enlarged view of a portion of the print head.

FIG. 5 shows a portion of the above-described pressure chambers 52 in an enlarged plan view perspective diagram. As stated previously, the pressure chambers 52 each have a substantially square shape, in which the nozzle 51 is formed in the bottom face in the region of one apex of the pressure chamber 52 (in FIG. 5, the bottom left-hand apex of the pressure chamber 52), the supply port 54 is formed on the upper surface on the opposite side of the pressure chamber 52 from the nozzle 51, the electrode pad 59 extends from the individual electrode 57 through a wire 59A, on the side adjacent to the nozzle 51 where the actuator 58 is not installed, and an electrical wire (electrical column) 90 is formed on the electrode pad 59.

Furthermore, as also shown in FIG. 4, the diaphragm 56 has tongue sections 56A, each of which is surrounded by the supply port 54 on three sides. As shown in FIG. 5, the tongue sections 56A provided in the diaphragm 56 have a substantially rectangular planar shape (a portion of each apex section being curved), and one of the short edges forming the rectangular shape is fixed to the diaphragm 56 (forming a fixed end), while the other short edge opposite to the fixed short edge can be displaced (forming a free end).

Figure 6:
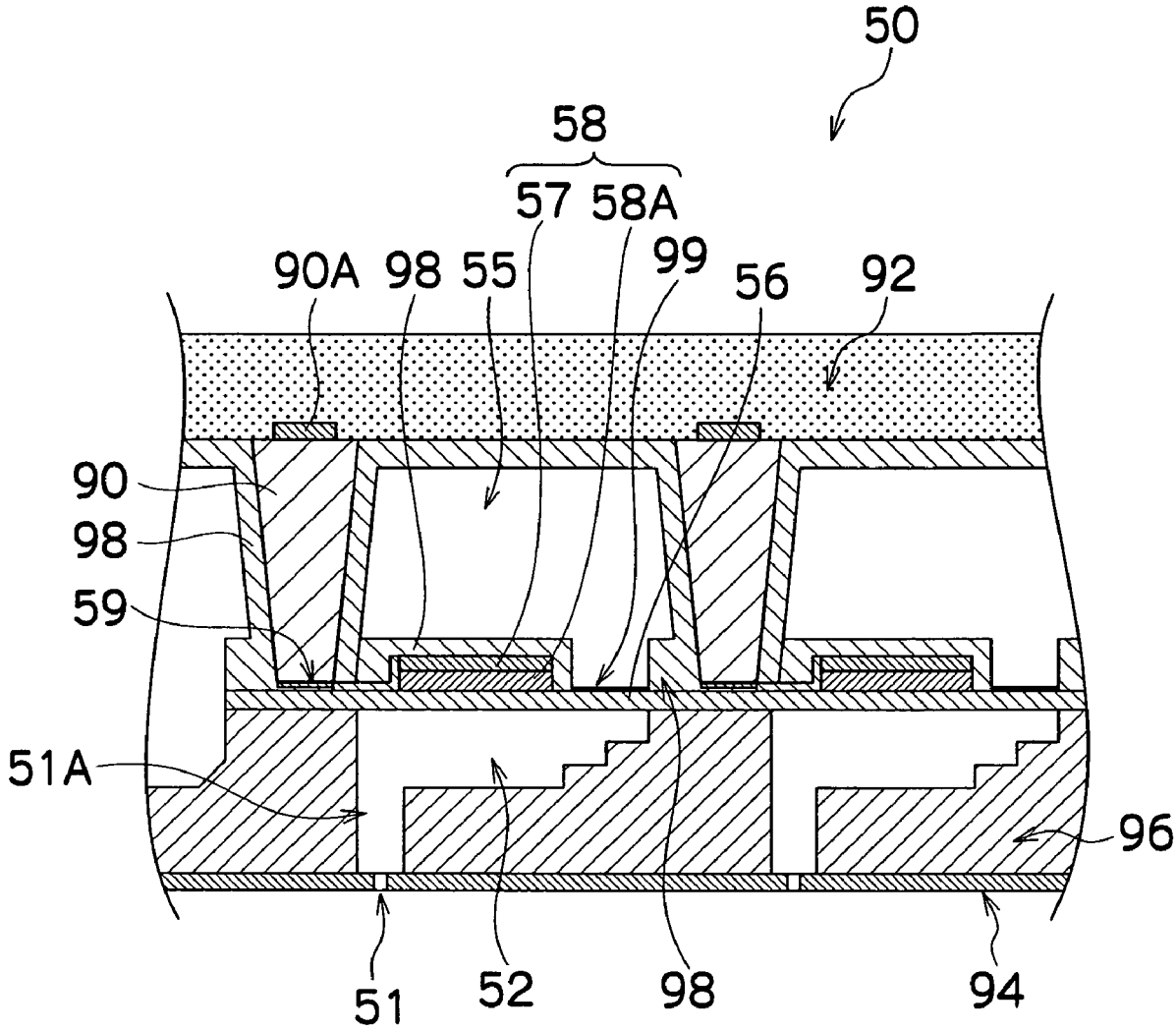
FIG. 6 is a cross-sectional view along line 6-6 in FIG. 5.

Here, FIG. 6 shows a cross-sectional diagram along line 6-6 in FIG. 5 (indicated by the single-dotted line). As shown in FIG. 6, the print head 50 according to the present embodiment is laminated from a plurality of thin films (plates). A flow channel plate 96 formed with the pressure chambers 52, the supply ports 54 and the nozzle flow channels 51. A linking the pressure chambers 52 and the nozzles 51, is arranged on a nozzle plate 94 formed with the nozzles 51. In FIG. 6, the flow channel plate 96 is shown as one plate, but in practice, the flow channel plate 96 has a laminated structure comprising a plurality of plates (see FIGS. 9A to 9C).

The diaphragm 56 forming the ceiling faces of the pressure chambers 52 is arranged on the flow channel plate 96. FIG. 6 shows the diaphragm 56 as being constituted by a single plate, but the diaphragm 56 according to the present embodiment has the two-layer structure, and a protective film 99 is provided on the sections which make contact with the ink (ink resistance processing is applied). The protective film 99 is not necessary in cases where a material having ink resistant properties is used for the sections which make contact with the ink. Although described in detail below, in the present embodiment, the protective film 99 is not necessary, since a resin of polyimide or the like, is used for the surface of the diaphragm 56 on the side adjacent to the pressure chambers 52. Furthermore, horseshoe-shaped opening sections corresponding to the supply ports 54 of the pressure chambers 52 are provided in the diaphragm 56, and direct connections between the pressure chambers 52 and the common liquid chamber 55 formed on the upper side of the diaphragm 56 are formed by means of these supply ports 54.

Piezoelectric bodies 58A are formed on the diaphragm 56 (common electrode) in regions corresponding to approximately the whole upper surfaces of the pressure chambers 52, and the individual electrodes 57 are formed on the upper surfaces of the piezoelectric bodies 58A. The piezoelectric body 58A sandwiched between the lower common electrode (diaphragm 56) and the upper individual electrode 57 in this way reduces the volume of the pressure chamber 52 by deforming when a voltage is applied through the common electrode 56 and the individual electrode 57, thereby constituting the actuator (piezoelectric actuator or piezoelectric element) 58 which causes ink to be ejected from the nozzle 51.

The electrode pad 59 forming the electrode connecting section extending to the outside is formed on the end of the individual electrode 57 adjacent to the nozzle 51. The column-shaped electrical wire (electrical column) 90 is formed perpendicularly on top of the electrode pad 59 in such a manner that the electrical column 90 passes through the common liquid chamber 55.

The multi-layer flexible printed circuit 92 is formed on top of the electrical wires 90, and wires (not shown) formed in the multi-layer flexible printed circuit 92 are connected through the electrodes pads 90A to the electrical wires 90, in such a manner that drive signals for driving the actuators 58 can be supplied through the electrical wires 90.

The space in which the column-shaped electrical wires (electrical columns) 90 are erected between the diaphragm 56 and the multi-layer flexible printed circuit 92 forms the common liquid chamber 55, in which ink for supplying to the pressure chambers 52 is accumulated, and since this space is filled with ink, the surfaces of the diaphragm 56, the individual electrodes 57, the piezoelectric bodies 58A, the electrical wires 90 and the multi-layer flexible printed circuit 92, that make contact with the ink are covered with the protective layer 98. The protective layer 98 formed on the sections of the electrical wires 90 and the multiple-layer flexible printed circuit 92 that make contact with the ink may have the same composition as the protective film 99 formed on the section of the diaphragm 56 that makes contact with the ink.

In this way, in the present embodiment, the common liquid chamber which is situated on the same side of the diaphragm as the pressure chambers in the related art is transferred to the upper side of the diaphragm, and hence is disposed on the opposite side to the pressure chambers. Therefore, in contrast to the related art, no channels are required to conduct the ink from the common liquid chamber to the pressure chambers, and furthermore, since the size of the common liquid chamber can be increased, the ink can be supplied efficiently at a prescribed refilling cycle, and high nozzle density can be achieved, while also enabling driving at a high ejection frequency (short ejection cycle) even when the nozzles are arranged at high density.

Moreover, since the wires connected to the individual electrodes of the actuators rise up perpendicularly from the electrode pads of the individual electrodes, then it is possible to increase the density of the wiring used to supply drive signals to the piezoelectric elements.

Furthermore, since the common liquid chamber is positioned on the upper side of the diaphragm in such a manner that the common liquid chamber and the pressure chambers are connected by means of the upright ink supply ports, it is possible to provide a direct fluid connection between the common liquid chamber and the pressure chambers, and moreover, since the common liquid chamber is positioned on the upper side of the diaphragm, it is possible to reduce the length of the nozzle flow channels 51A from the pressure chambers 52 to the nozzles 51, in comparison with the related art, and even if the nozzles are formed to a high density, it is still possible to eject ink of high viscosity (for example, approximately 20 cP to 50 cP) and a flow channel structure capable of swift refilling after ejection is achieved.

Figure 7:
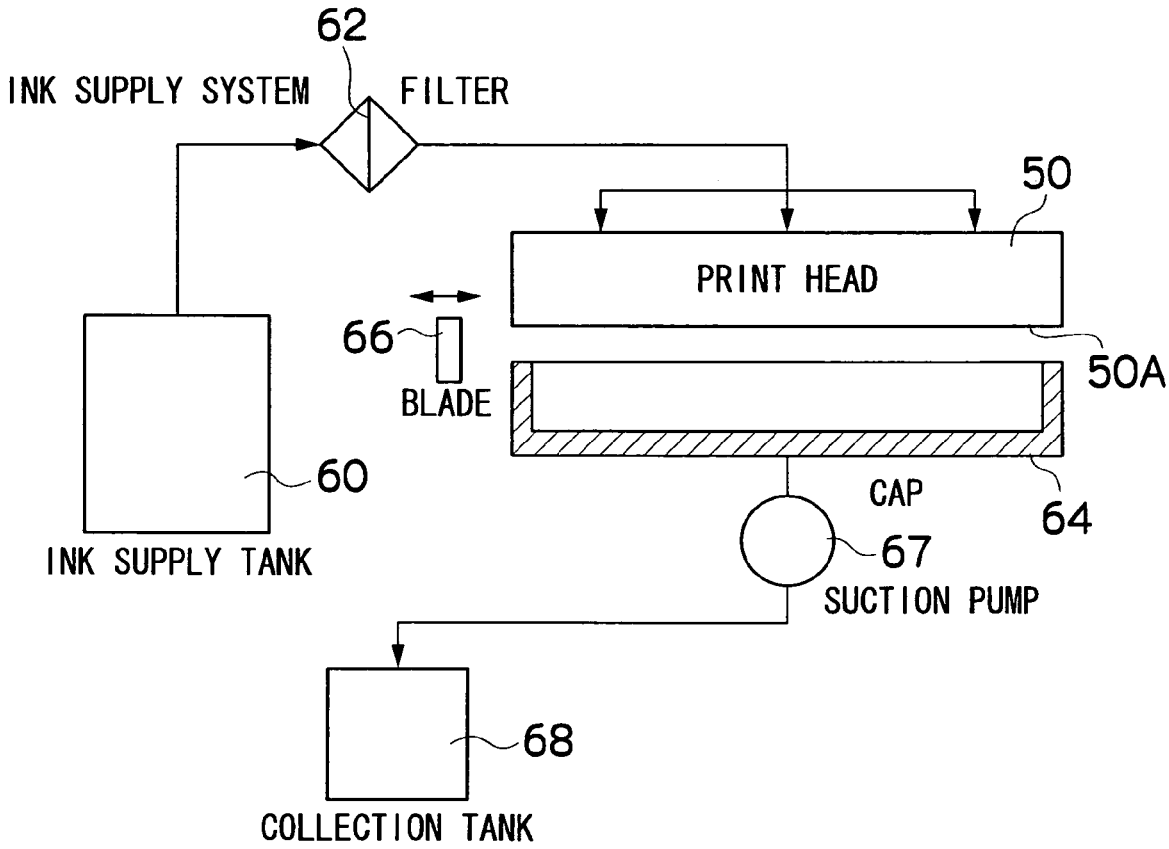
FIG. 7 is a schematic drawing showing the composition of an ink supply system in the inkjet recording apparatus.

FIG. 7 is a schematic drawing showing the configuration of the ink supply system in the inkjet recording apparatus 10. The ink supply tank 60 is a base tank that supplies ink to the print head 50 and is set in the ink storing and loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

A filter 62 for removing foreign matters and bubbles is disposed in the middle of the channel connecting the ink supply tank 60 and the print head 50 as shown in FIG. 7. The filter mesh size in the filter 62 is preferably equivalent to or less than the diameter of the nozzle of the print head 50 and commonly about 20 μm.

Although not shown in FIG. 7, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles from drying out or to prevent an increase in the ink viscosity in the vicinity of the nozzles 51, and a cleaning blade 66 as a device to clean the ink ejection surface.

A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power of the inkjet recording apparatus 10 is turned OFF or when in a print standby state, the cap 64 is raised to a predetermined elevated position by the elevator mechanism so as to come into close contact with the print head 50, and the nozzle area of the ink ejection surface is thereby covered with the cap 64.

The cleaning blade 66 is composed of rubber or another elastic member, and can slide on the ink ejection surface of the print head 50 by means of a blade movement mechanism (not shown). If ink droplets or foreign matter becomes attached to the ink ejection surface, then the ink ejection surface is wiped by sliding the cleaning blade 66 over the ink ejection surface, thereby cleaning the ink ejection surface.

During printing or standby, when the frequency of use of specific nozzles 51 is reduced and ink viscosity increases in the vicinity of the nozzles 51, a preliminary discharge is made to eject the ink which is degraded due to the increased viscosity, toward the cap 64.

Also, when bubbles have become intermixed in the ink inside the print head 50 (ink inside the pressure chamber 52), the cap 64 is placed on the print head 50, the ink inside the pressure chamber 52 (the ink in which bubbles have become intermixed) is removed by suction with a suction pump 67, and the suction-removed ink is sent to a collection tank 68. This suction action entails the removal by suction of degraded ink whose viscosity has increased and hardened also when initially loaded into the print head, or when service has started after a long period of being stopped.

More specifically, when a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the actuator 58 for the ejection driving is operated. Before reaching such a state (in a viscosity range that allows ejection by the operation of the actuator 58) the actuator 58 is operated to perform the preliminary discharge to eject the ink whose viscosity has increased in the vicinity of the nozzle toward the ink receptor. After the ink ejection face is cleaned by a wiper such as the cleaning blade 66 provided as the cleaning device for the ink ejection face, a preliminary discharge is also carried out in order to prevent the foreign matter from becoming mixed inside the nozzle 51 by the wiper sliding operation. The preliminary discharge is also referred to as "dummy discharge", "purge", "liquid discharge", and so on.

When bubbles have become intermixed inside the nozzle 51 or the pressure chamber 52, or when the ink viscosity inside the nozzle 51 has increased over a certain level, ink can no longer be ejected by the preliminary discharge, and a suctioning action is carried out as above.

More specifically, when bubbles have become intermixed into the ink inside the nozzles 51 and the pressure chambers 52, or when the ink viscosity in side the nozzle 51 has increased to a certain level or more, ink can no longer be ejected from the nozzles even if the pressure generating devices are operated. In a case of this kind, a cap 64 is placed on the ink ejection surface of the print head 50, and the ink containing air bubbles or the ink of increased viscosity inside the pressure chambers 52 is suctioned by a suction pump 67.

However, this suction action is performed with respect to all of the ink in the pressure chambers 52, and therefore the amount of ink consumption is considerable. Consequently, it is desirable that a preliminary ejection is carried out, whenever possible, while the increase in viscosity is still minor. The cap 64 shown in FIG. 7 functions as a suctioning device and it may also function as an ink receptacle for preliminary ejection.

Moreover, desirably, the inside of the cap 64 is divided by means of partitions into a plurality of areas corresponding to the nozzle rows, thereby achieving a composition in which suction can be performed selectively in each of the demarcated areas, by means of a selector, or the like.

Figure 8:
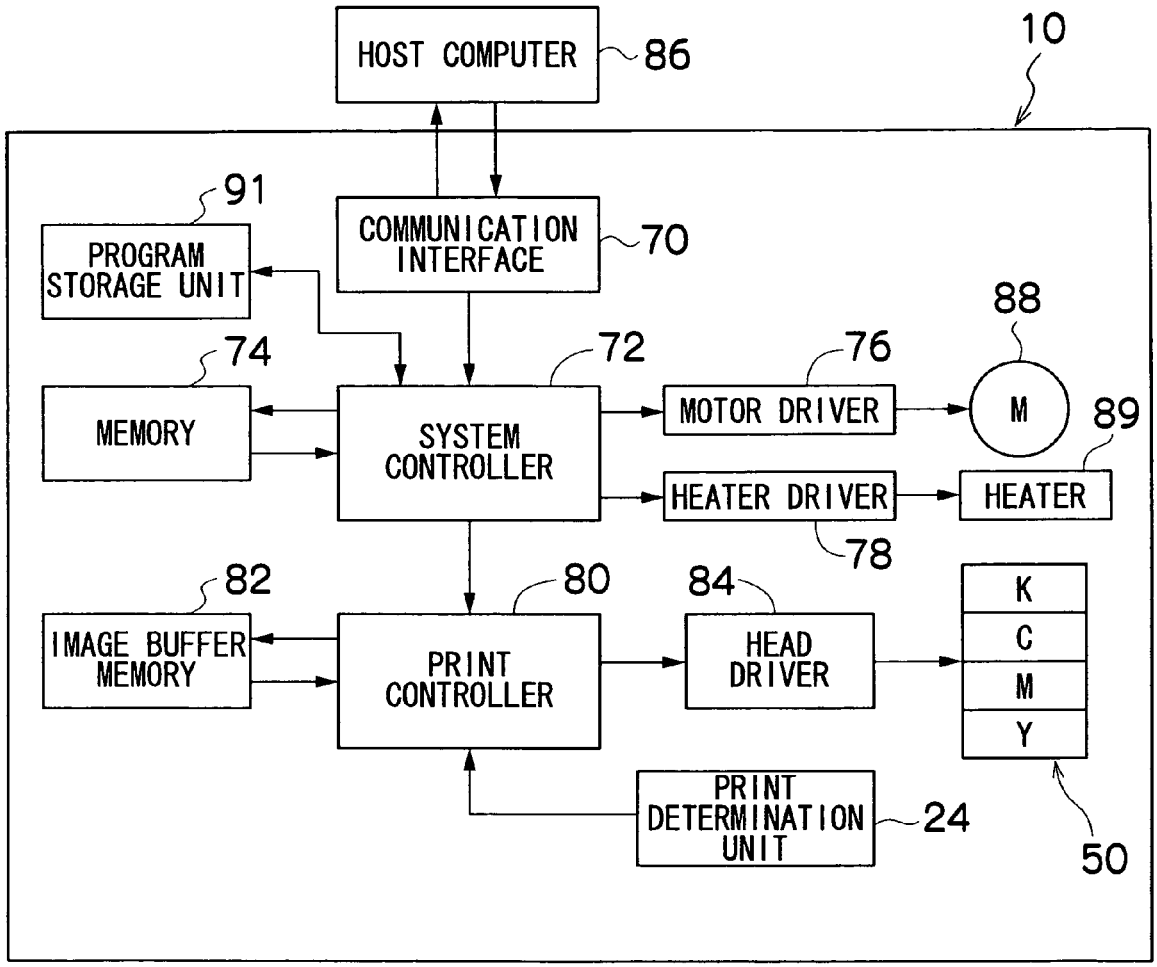
FIG. 8 is a principal block diagram showing the system composition of the inkjet recording apparatus.

FIG. 8 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communications interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print control signal (print data) to the head driver 84. Prescribed signal processing is carried out in the print controller 80, and the ejection amount and the ejection timing of the ink droplets from the respective print heads 50 are controlled through the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 8 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the pressure generating devices of the print heads 50 of the respective colors on the basis of print data supplied by the print controller 80. The head driver 84 can be provided with a feedback control system for maintaining constant drive conditions for the print heads.

As shown in FIG. 1, the print determination unit 24 is a block including a line sensor (not shown), which reads in the image printed onto the recording paper 16, performs various signal processing operations, and the like, and determines the print situation (presence/absence of ejection, variation in droplet ejection, and the like). The print determination unit 24 supplies these determination results to the print controller 80. According to requirements, the print controller 80 makes various corrections with respect to the print head 50 on the basis of information obtained from the print determination unit 24.

Various control programs are stored in a program storage section 91, and a control program is read out and executed in accordance with commands from the system controller 72. The program storage section 91 may be a semiconductor memory, such as a ROM, EEPROM, or a magnetic disk, or the like. The program storage section 91 may be provided with an external interface, and a memory card or PC card may also be used. Naturally, a plurality of these storage media may also be provided in the program storage section 91.

The program storage section 91 may also be combined with a storage device for storing operational parameters, and the like (not shown).

Description of Structure of Diaphragm

Figure 9A:
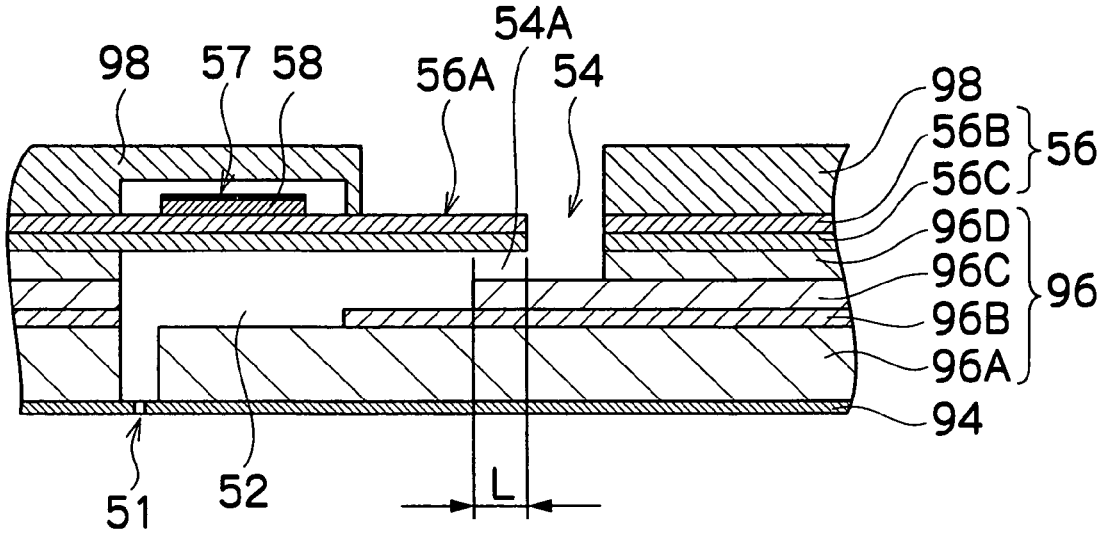
FIGS. 9A, 9B and 9C are cross-sectional diagrams along lines 9A-9A, 9B-9B and 9C-9C in FIG. 5, respectively.
Figure 9B:
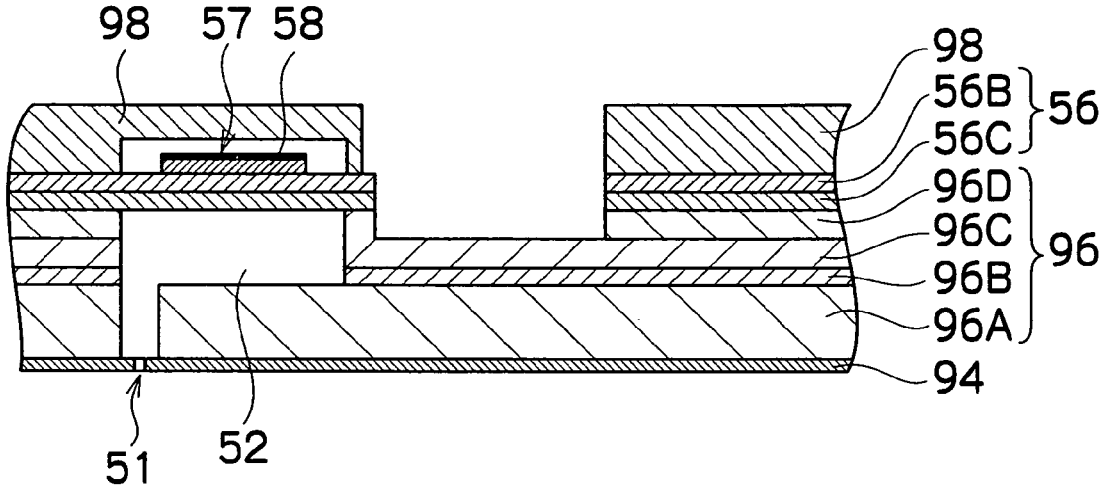
Figure 9C:
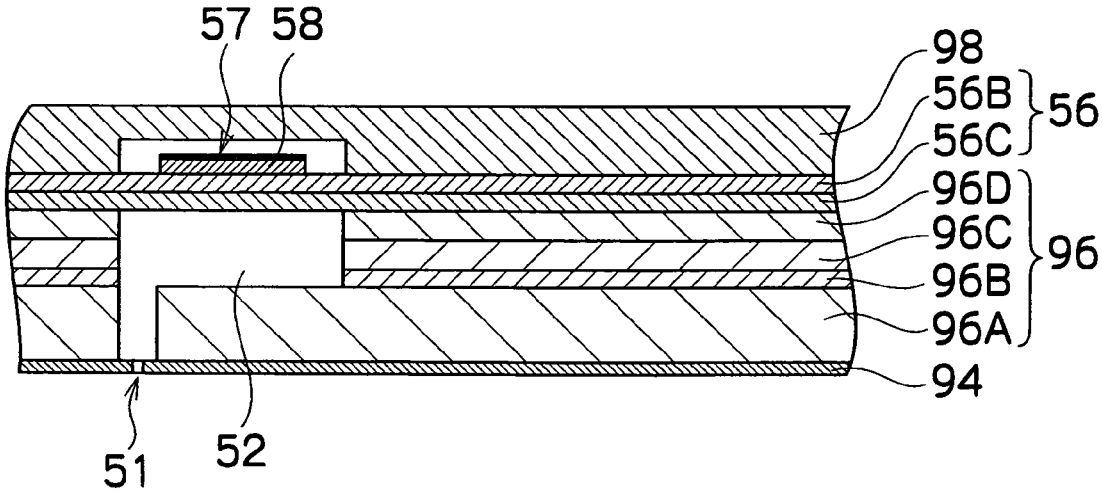

Next, the structure of the diaphragm 56 according to the present embodiment is described in detail. FIGS. 9A to 9C show the three-dimensional structure of the print head 50, and are cross-sectional diagrams along lines 9A-9A, 9B-9B and 9C-9C in FIG. 5, respectively. A portion of the members to the upper side of the surface where the actuators 58 are provided, namely, the electrical wires 90 and the flexible printed circuit 92, and the like, shown in FIG. 6, are omitted from FIGS. 9A to 9C.

As described with reference to FIG. 6, the print head 50 has the laminated structure in which the plurality of cavity plates are bonded together. More specifically, the nozzle plate 94 formed with the nozzles 51, the flow channel plate 96 formed with the pressure chambers 52 and the like, the diaphragm 56 having the two layers, the upper layer 56B and the lower layer 56C, the protective layer 98 protecting the actuators 58, and the like, disposed on the opposite side of the diaphragm 56 from the pressure chambers 52, are successively bonded together. The thicknesses of the layers (cavity plates) shown in the drawings are simply examples.

The flow channel plate 96 is constituted by a plurality of plates. More specifically, the flow channel plate 96 shown in FIGS. 9A to 9C comprises a plate 96A and a plate 96B in which the nozzle flow channels 51. A are formed, a plate 96C forming the bottom face (non-deformable wall) of the supply flow channels 54A, and a plate 96D which supports the diaphragm 56. Of course, each of these plates may also be formed of a plurality of plates. A metallic material such as stainless steel, and a resin material such as polyimide, or the same piezoelectric material (piezoelectric ceramic), or the like, used for the actuators 58 may be used for the plates constituting the flow channel plate 96.

The two layers constituting the diaphragm 56 are made of different materials in which the coefficient of linear expansion $\alpha 1$ of the upper layer (actuator side layer) 56B is smaller than the coefficient of linear expansion $\alpha 2$ of the lower layer (pressure chamber side layer) 56C. The upper layer 56B is preferably made of silicon, a metal material such as stainless steel, or a metal oxide material such as magnesium oxide, or the like, and the lower layer 56C is preferably made of a resin material such as polyimide, polyamide or polyethylene, having a relatively high coefficient of linear expansion. More desirably, a metal material is used for the upper layer 56B, since this allows the layer to also serve as the common electrode for the actuators 58.

FIG. 10 shows the coefficients of linear expansion, thicknesses and elasticity coefficients, of the upper layer 56B and the lower layer 56C in the present embodiment. As shown in FIG. 10, in the present embodiment, the upper layer 56B is made of a metal material such as stainless steel having the coefficient of linear expansion $\alpha 1$ of $1.5\times10^{-5}$ $K^{-1}$, the thickness t1 of $1.0\times10^{-5}$ m, and the elasticity coefficient E1 of $2.0\times10^{11}$ Pa. The lower layer 56C is made of a resin material having the coefficient of linear expansion $\alpha 2$ of $1.0\times10^{-4}$ $K^{-1}$, the thickness t2 of $3.0\times10^{-5}$ m, and the elasticity coefficient E2 of $3.0\times10^{9}$ Pa. The length L of the tongue section 56A shown in FIGS. 9A to 9C (the length of the supply flow channel 54A) is $6.0\times10^{-4}$ m.

As shown in FIG. 10, the ratio of the coefficient of linear expansion $\alpha 2$ of the lower layer 56C with respect to the coefficient of linear expansion $\alpha 1$ of the upper layer 56B is about 6.7, and it is desirable that the materials of the upper layer 56B and the lower layer 56C are selected in such a manner that $\alpha 2/\alpha 1>6$, since this makes it possible to achieve a large amount of deformation in the tongue section 56A.

As shown in FIG. 9A, the tongue section 56A having one edge fixed to the diaphragm 56 forms a portion of the upper surface of the supply flow channel 54A and functions as a supply restrictor through which the ink is supplied to the pressure chamber 52. The supply flow channel (supply restrictor) 54A according to the present embodiment is a portion of the supply side ink flow channel between the supply port 54 and the pressure chamber 52, and is defined as a region having the bottom face formed by the plate 96C, which constitutes the flow channel plate 96, and the ceiling face formed by the tongue section 56A. The pressure chamber 52 of the present embodiment is defined as a section having the ceiling face formed by the diaphragm 56, and the bottom face formed by the plate 96A constituting the flow channel plate 96. The section having the ceiling face formed by the diaphragm 56 and the bottom face formed by the plate 96B, is a portion of the supply side ink flow channel (or a portion of the pressure chamber 52) provided in order to achieve the designed volume and flow channel resistance in the pressure chamber 52.

Figure 11:
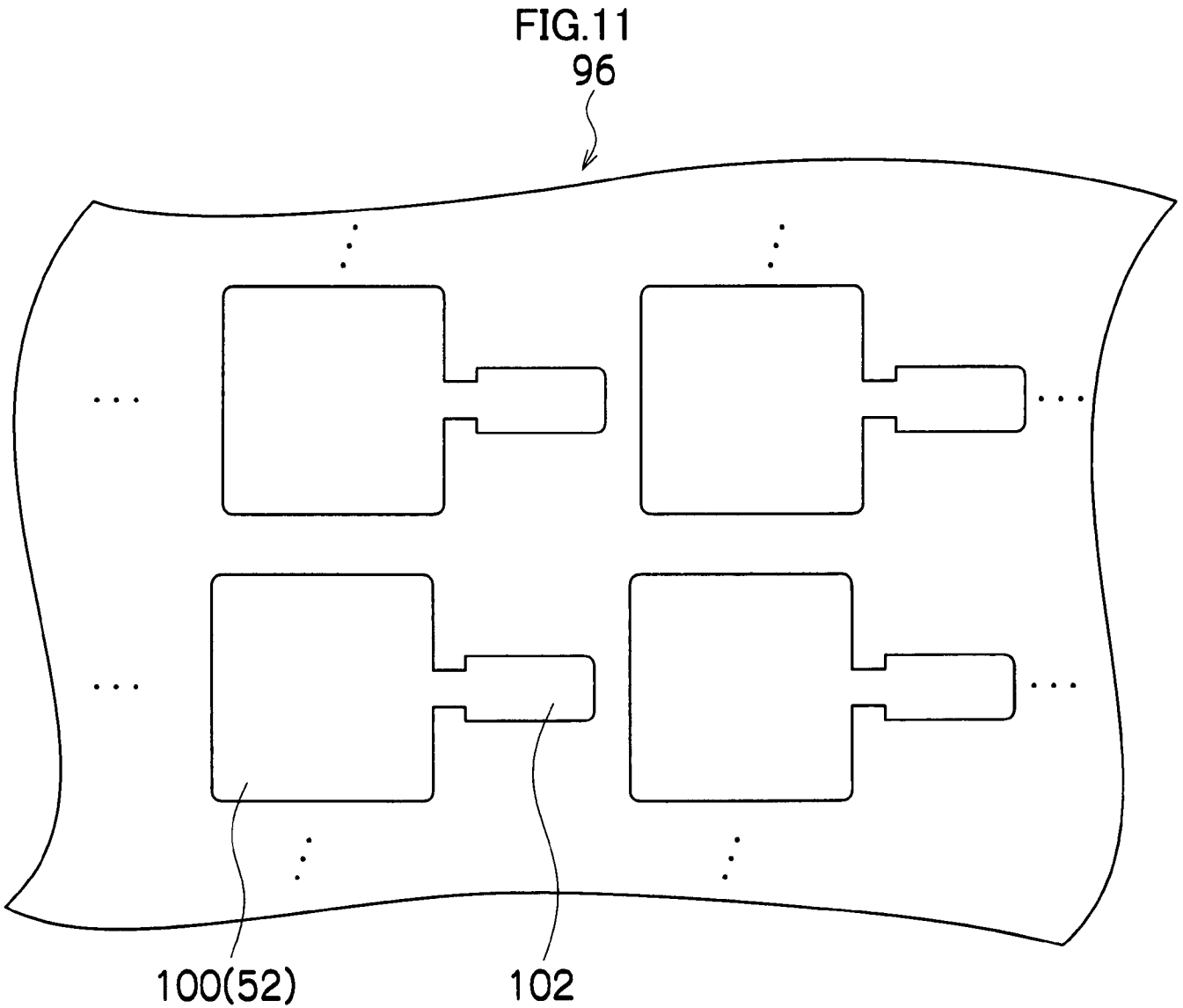
FIG. 11 is a plan diagram showing the structure of a flow channel plate.
Figure 12:
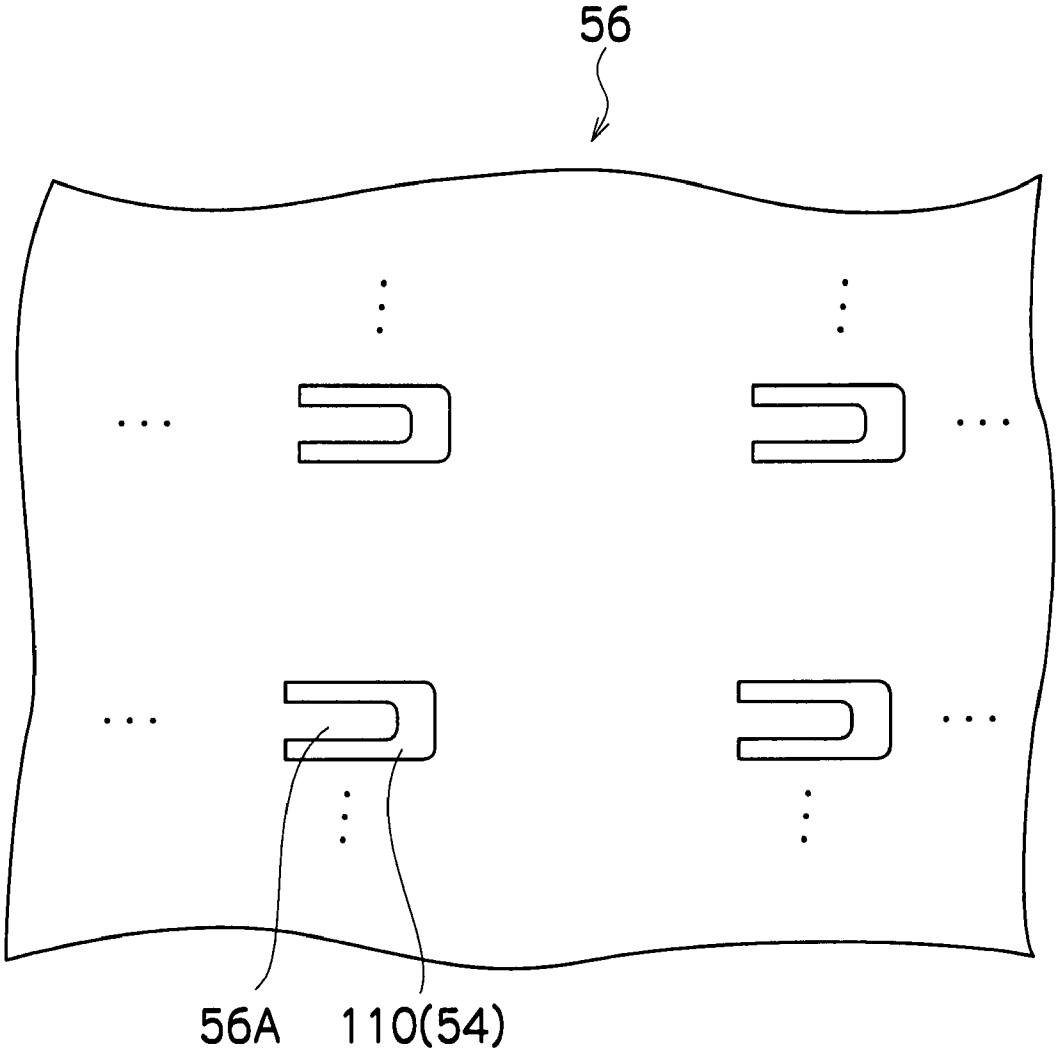
FIG. 12 is a plan diagram showing the structure of a diaphragm plate.

FIGS. 11 and 12 show plan diagrams in which the flow channel plate 96 and the diaphragm 56 are viewed from the side adjacent to the common liquid chamber 55, respectively.

As shown in FIG. 11, the flow channel plate 96 is formed with substantially square-shaped opening sections 100 to form the pressure chambers 52, and recess sections (or opening sections) 102 to form the ink supply side ink flow channels comprising the supply ports 54, the supply flow channels 54A, and the like. The recess sections 102 are actually constituted by a plurality of recess sections of different depths, but in FIG. 11, the external shape of the recess sections 102 is shown in order to simplify the diagrams.

As shown in FIG. 12, the diaphragm 56 is formed with horseshoe-shaped (substantially square U-shaped) opening sections 110 to form the supply ports 54, and the tongue-shaped sections 56A are formed so as to be surrounded on three edges by the supply port 54. Of the short edges of each tongue section 56A, the front end section forms the free end, and the other end section forms the fixed end held on (fixed to) the diaphragm 56. In other words, one portion of the perimeter of each tongue section 56A is fixed to the diaphragm 56, and the front end section has a structure which is displaceable in the thickness direction (in such a manner that the tongue section 56A alters the size of the supply flow channel 54A).

The present embodiment relates to a mode in which the planar shape of the supply ports 54 is a horseshoe shape when viewed in the direction of ink ejection, but the planar shape of the supply ports 54 is not limited to this. In other words, it is also possible to adopt various other shapes for the planar shape of the tongue sections 56A formed in the diaphragm 56 when viewed in the direction of ink ejection, such as a substantially rectangular shape, a substantially square shape, a substantially rhombic shape, or another quadrilateral shape, or a substantially triangular shape, a substantially circular shape, a substantially elliptical shape, or the like.

Figure 13A:
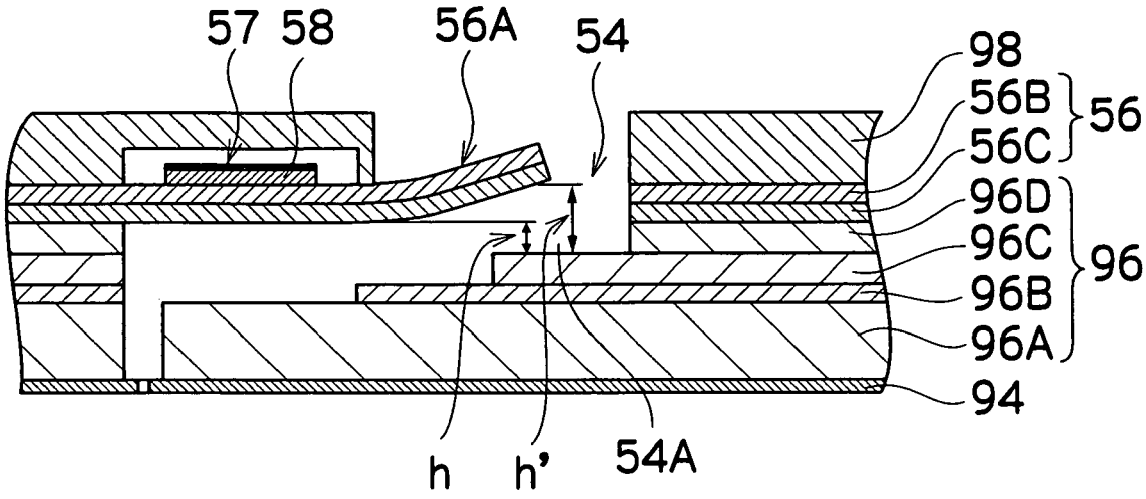
FIGS. 13A and 13B are diagrams showing deformation of the tongue section.
Figure 13B:
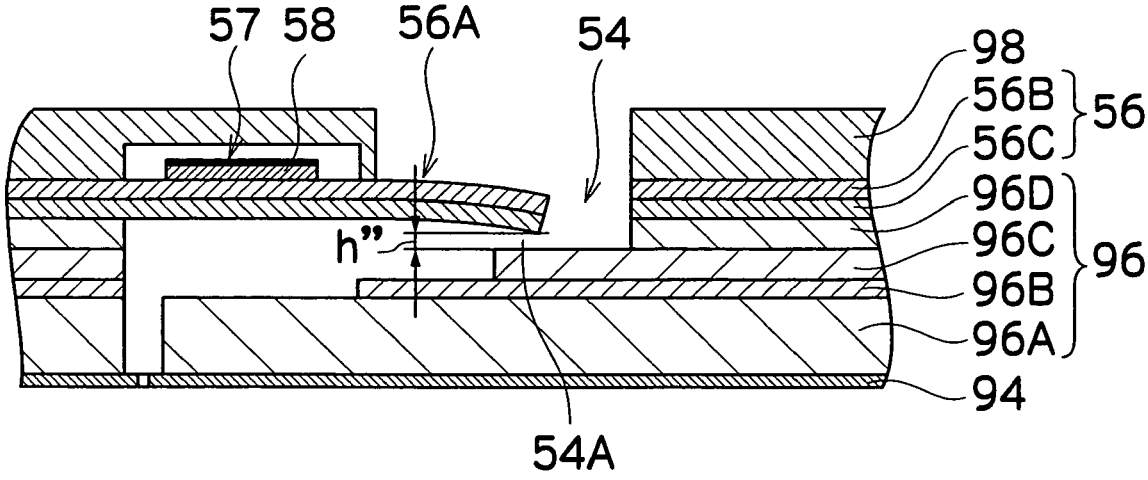

Next, the distortion of the tongue sections 56A is described in detail with reference to FIGS. 13A and 13B. As shown in FIGS. 13A and 13B, when the temperature of the print head 50 (ink temperature) changes, each of the tongue sections 56A deforms due to bimetal-like effect (through the lower layer 56C is not metal but resin in the present embodiment), thereby changing the size of the corresponding supply flow channel 54A. If the ink temperature (the ambient temperature of the tongue section 56A) T is a prescribed temperature (initial temperature T0), then the tongue section 56A does not deform, as shown in FIG. 9A, and the supply flow channel 54A has a prescribed cross-sectional area (indicated by the height h of the supply flow channel 54A in FIG. 13A). If the ink temperature T is higher than the initial temperature T0 (in other words, if T>T0), then the amount of expansion of the lower layer 56C is greater than the amount of expansion of the upper layer 56B, due to the difference in the coefficient of linear expansion between the upper layer 56B and the lower layer 56C forming the diaphragm 56, and therefore, the tongue section 56A deforms and bends toward the common liquid chamber 55, as shown in FIG. 13A.

In other words, in a state of T>T0, where the ink temperature T is higher than the initial temperature T0, the cross-sectional area of the supply flow channel 54A is increased. More specifically, the height h of the supply flow channel 54A shown in FIG. 13A becomes h' (where h'>h). When the cross-sectional area of the supply flow channel 54A is increased in this way, the flow channel resistance of the supply flow channel 54A decreases, and the ink flows more readily from the pressure chamber into the ink flow channel on the supply side (in other words, the ink becomes less liable to flow from the pressure chamber to the nozzle side).

On the other hand, when the ink temperature T is lower than the initial temperature T0 (where T<T0), then as shown in FIG. 13B, the tongue section 56A deforms and bends toward the pressure chamber 52. In other words, in a state of T<T0, where the ink temperature T is lower than the initial temperature T0, the cross-sectional area of the supply flow channel 54A becomes smaller (the height h of the supply flow channel 54A shown in FIG. 13A becomes h" (where h"<h)). When the cross-sectional area of the supply flow channel 54A is reduced in this way, the flow channel resistance of the supply flow channel 54A increases, and the ink flows becomes less liable to flow from the pressure chamber into the ink flow channel on the supply side (in other words, the ink becomes more liable to flow from the pressure chamber to the nozzle side).

Figure 14:
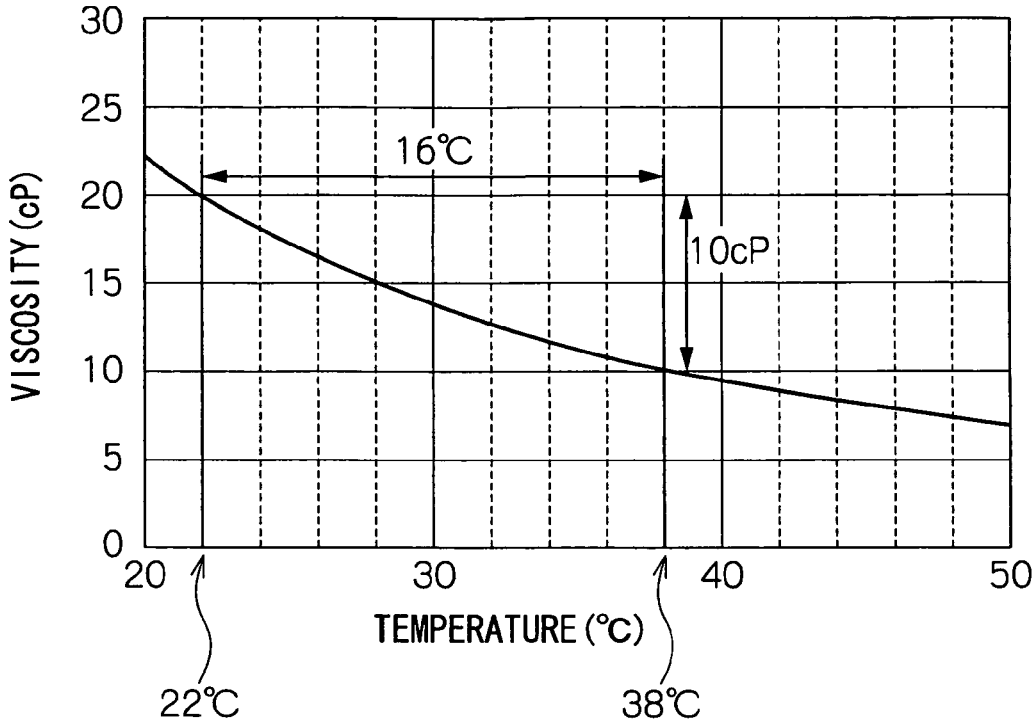
FIG. 14 is a graph showing the relationship between the ink temperature and the ink viscosity.
Figure 15:
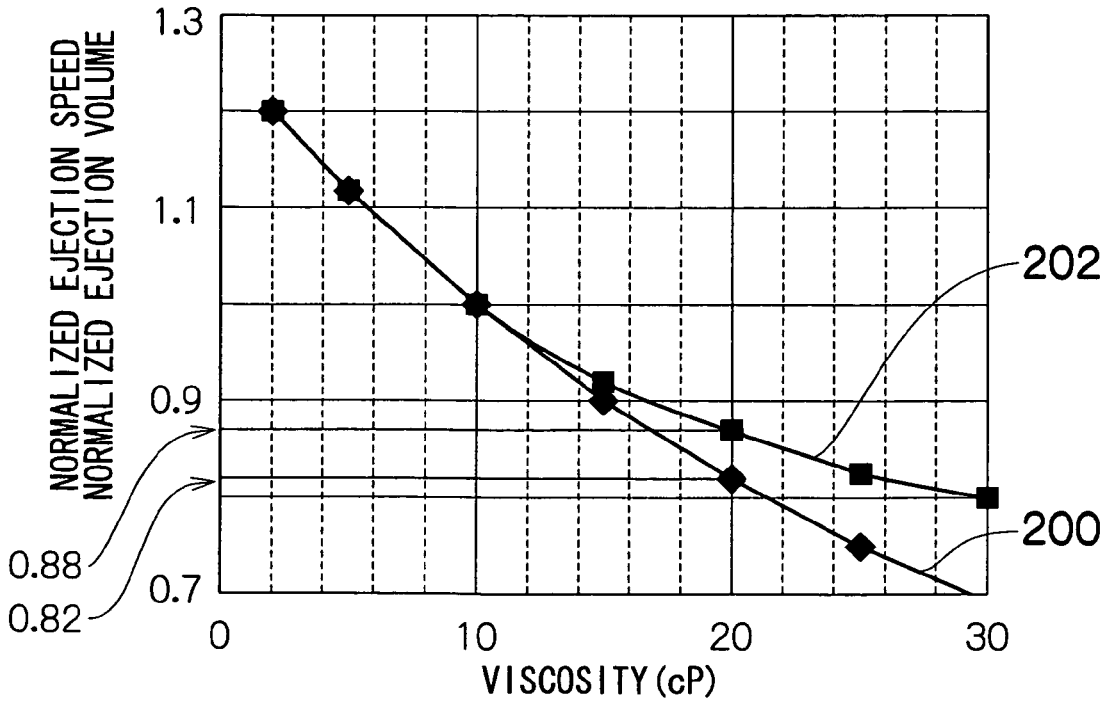
FIG. 15 is a graph showing the relationship between the ink viscosity, the ink ejection speed and the ink ejection volume.

The ink properties and the ejection characteristics are described with reference to FIGS. 14 and 15. FIG. 14 shows the relationship between the ink temperature and the ink viscosity, and FIG. 15 shows the relationship between the ejection characteristics (ink ejection speed and volume) and the ink viscosity. As shown in FIG. 14, the ink viscosity tends to become lower, as the ink temperature rises. For example, if the ink temperature T changes from approximately 22° C. to approximately 38° C., then the ink viscosity changes from approximately 20 cP to approximately 10 cP. In other words, a change of approximately 16° C. in the temperature of ink at approximately 22° C. produces a reduction of approximately 10 cP in the viscosity of ink.

FIG. 15 shows the relationship between the ink viscosity and the normalized ink ejection speed (taking the ink ejection speed at the ink viscosity of 10 cP to be the reference value), and the relationship between the ink viscosity and the normalized ink ejection volume (taking the ink ejection volume at the ink viscosity of 10 cP to be the reference value) in an inkjet head in the related art. In FIG. 15, a curve 200 indicates the normalized ink ejection speed, and a curve 202 indicates the normalized ink ejection volume. As shown in FIG. 15, when the ink viscosity changes from 10 cP to 20 cP, the ejection speed becomes a factor of approximately 0.82 times the reference value, and the ejection volume becomes a factor of approximately 0.88 times the reference value. In other words, if the ink viscosity rises, the ink ejection speed and the ink ejection volume both fall, and the ink ejection characteristics decline.

In other words, in the inkjet head in the related art, if the ink temperature T increases, then the ink viscosity falls and the ink ejection speed and the ink ejection volume both rise, thereby making liquid droplets form more readily and thus facilitating the ejection of liquid droplets.

Figure 16:
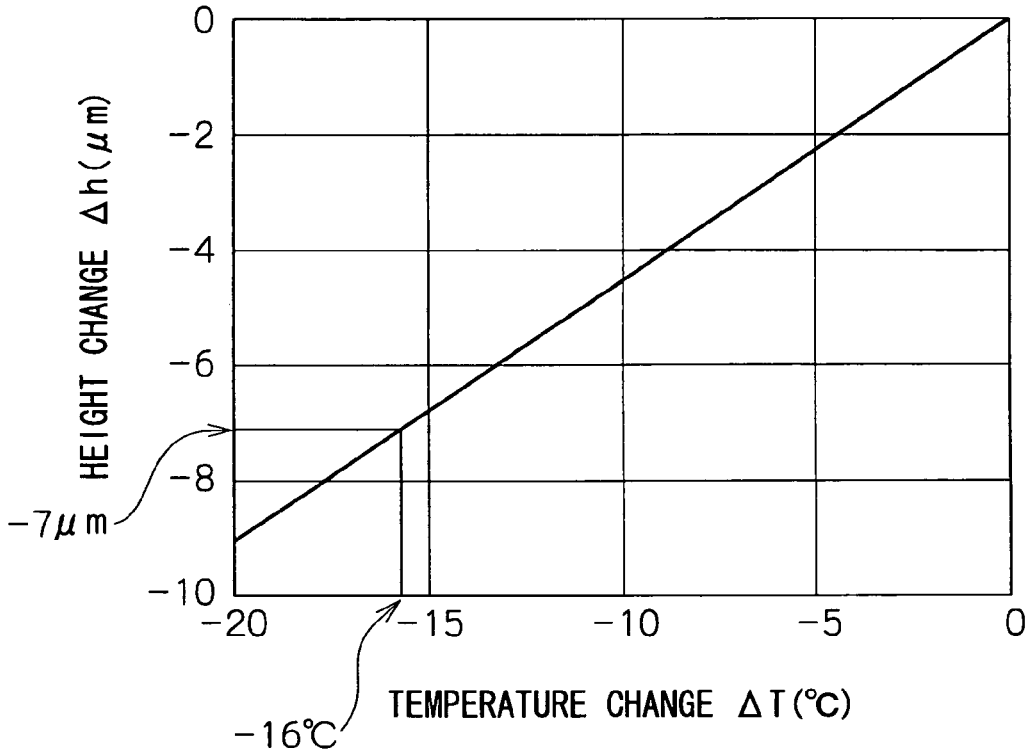
FIG. 16 is a graph showing the relationship between the amount of change in the ink temperature, and the amount of change in the height of the supply flow channel.

FIG. 16 shows the relationship between the ink temperature (ambient temperature of the tongue section 56A on the diaphragm 56) and the amount of change in the height h of the supply flow channel 54A (the amount of displacement of the region of the front end of the tongue section 56A, or in other words, the maximum amount of change in the tongue section 56A). The horizontal axis in FIG. 16 shows the amount of change ΔT (° C.) in the ink temperature T, and the vertical axis shows the amount of change Δh (μm) in the height h of the supply flow channel 54A. As shown in FIG. 16, when the ink temperature falls by 16° C. (namely, ΔT=−16° C.; a state where the ink viscosity has risen by 10 cP in FIG. 14), then the amount of change Δh in the height h of the supply flow channel 54A is approximately −7 μm, and if the original height of the supply flow channel 54A is 35 μm, then the cross-sectional area of the supply flow channel 54A becomes 0.8 times the original area. In other words, when the ink temperature falls by 16° C., the front end section of each of the tongue sections 56A in the diaphragm 56 is displaced through 7 μm towards the pressure chamber 52, thereby reducing the size (cross-sectional area) of the supply flow channel 54A. If the size of the supply flow channel 54A is reduced in this way, then the flow channel resistance of the supply flow channel 54A increases. Conversely, if the ink temperature T rises, then the cross-sectional area of the supply flow channel 54A increases, and the ink becomes more liable to flow from the pressure chamber to the supply port side than to the nozzle side during an ejection operation. Consequently, the ejection volume tends to decline and ejection of a liquid droplet becomes more difficult.

Figure 17:
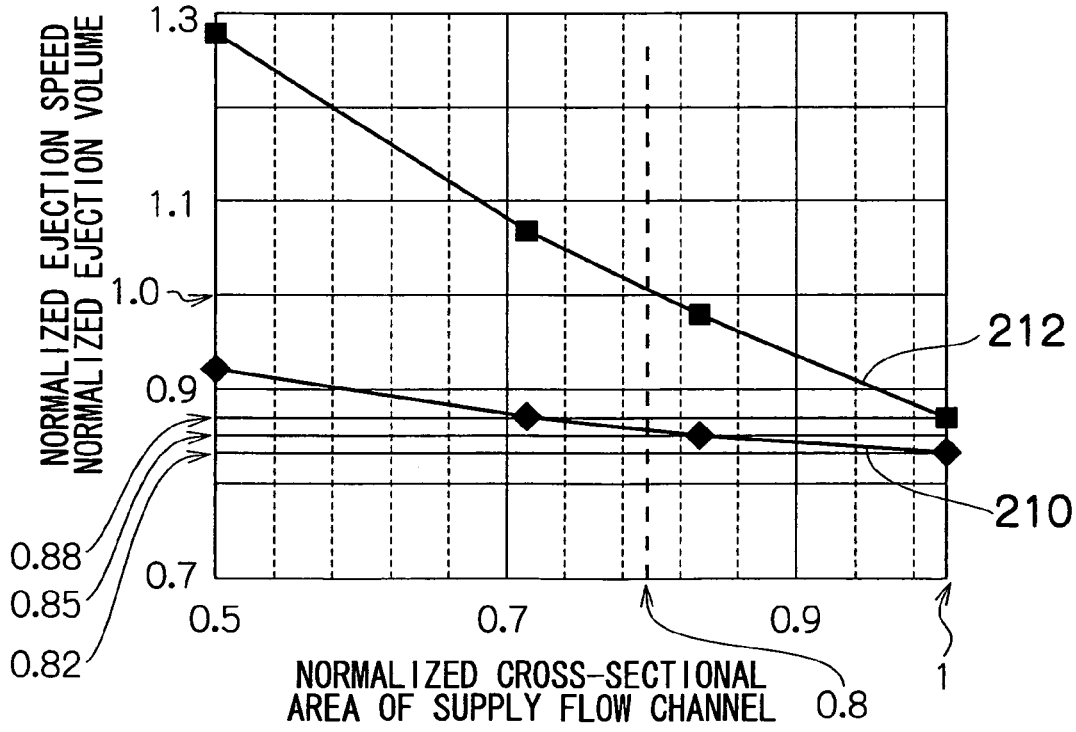
FIG. 17 is a graph showing the relationship between the cross-sectional area of the supply flow channel, the ink ejection speed and the ink ejection volume.

Next, FIG. 17 shows the relationship between the normalized cross-sectional area of the supply flow channel 54A (taking the cross-sectional area of the supply flow channel 54A at the ink viscosity of 20 cP shown in FIG. 15 to be the reference value), and the normalized ink ejection speed and the normalized ink ejection volume. In FIG. 17, the horizontal axis represents the normalized cross-sectional area of the supply flow channel 54A and the vertical axis represents the normalized ink ejection speed and the normalized ink ejection volume. In FIG. 17, a curve 210 indicates the normalized ink ejection speed, and a curve 212 indicates the normalized ink ejection volume.

As shown in FIG. 17, when the cross-sectional area of the supply flow channel 54A becomes 0.8 times the area of the stationary state where the tongue section 56A produces no distortion or deformation, then the ink ejection volume changes to 1.0 from 0.88 of the stationary state of the tongue section 56A. Furthermore, the ink ejection speed changes to 0.85 from 0.82 of the stationary state of the tongue section 56A. This indicates that when the cross-sectional area of the supply flow channel 54A is reduced, the ink ejection volume rises, and the ink ejection speed also rises.

More specifically, as indicated by the curve 202 in FIG. 15, if the ink viscosity rises from 10 cP to 20 cP due to a fall in the ink temperature, for example, then the normalized ink ejection volume declines from 1.0 to 0.88 in the related art. On the other hand, as indicated by the curve 212 in FIG. 17, when the normalized cross-sectional area of the supply flow channel 54A changes from 1.0 to 0.8 by the deformation of the tongue section 56A by the bimetal-like effect due to the fall in the ink temperature, then the normalized ejection volume is corrected from 0.88 to 1.0, and hence the prescribed ejection volume can be achieved in the present embodiment.

Moreover, as indicated by the curve 200 in FIG. 15, if the ink viscosity rises from 10 cP to 20 cP due to a fall in the ink temperature, then the normalized ink ejection speed declines from 1.0 to 0.82 in the related art. On the other hand, as indicated by the curve 210 in FIG. 17, when the normalized cross-sectional area of the supply flow channel 54A changes from 1.0 to 0.8 by the deformation of the tongue section 56A by the bimetal-like effect due to the fall in the ink temperature, then the normalized ejection speed is corrected from 0.82 to 0.85, and the ejection speed does not satisfy the prescribed ejection speed but is improved in the present embodiment.

In this way, when the ink temperature falls, the ink ejection volume and the ink ejection speed are increased by reducing the cross-sectional area of the supply flow channel 54A so as to counteract the reduction in the ink ejection volume and the ink ejection speed caused by increased viscosity of the ink. Thus, the change in the ink ejection volume caused by temperature change is cancelled out, and the amount of change in the ejection speed caused by temperature change can be restricted.

Description of Elasticity Coefficients of Two Layers Constituting Diaphragm

Figure 18:
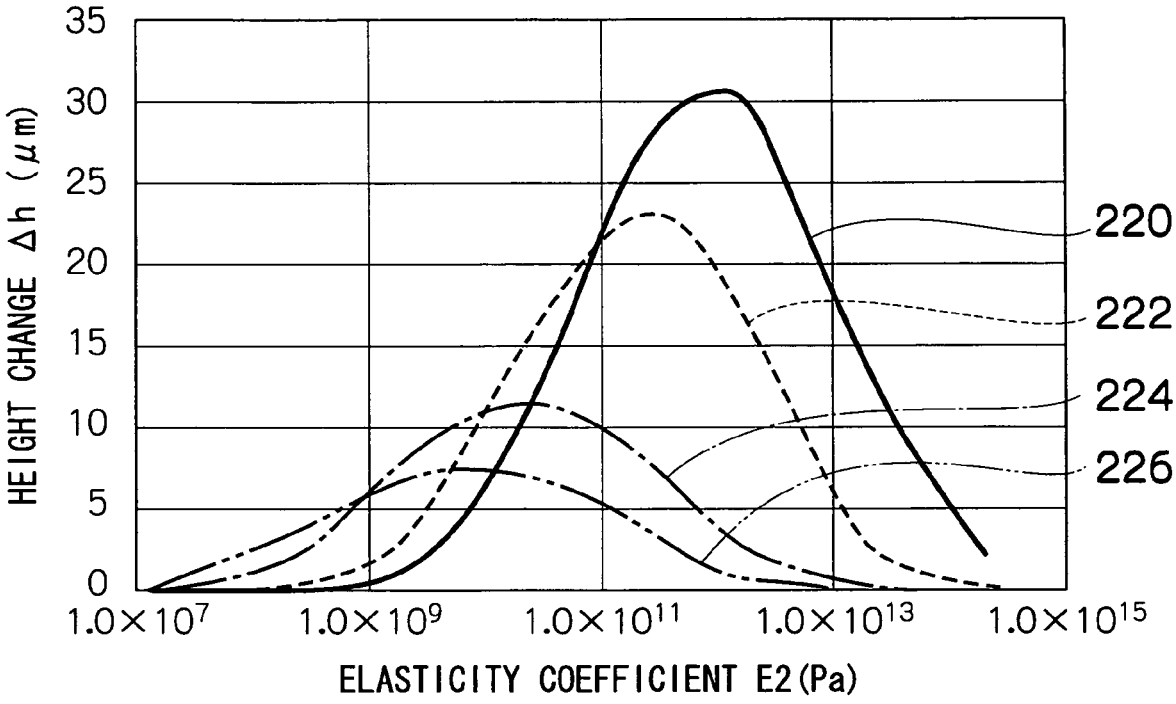
FIG. 18 is a graph showing the relationship between the elasticity coefficient of the lower layer, and the amount of change in the height of the supply flow channel.

Next, the elasticity coefficients of the two layers (the upper layer 56B and the lower layer 56C) constituting the diaphragm 56 are described in detail with reference to FIG. 18. FIG. 18 shows the relationship between the elasticity coefficient and the amount of change in the height of the supply flow channel 54A. In FIG. 18, the horizontal axis shows the elasticity coefficient E2 (Pa) of the lower layer 56C, and the vertical axis shows the amount of change Δh (μm) of the height of the supply flow channel 54A, in a state where the change in the ink temperature ΔT=20° C. and the upper layer 56B has the thickness t1 of 10 μm and the elasticity coefficient E1 of $2.0\times10^{11}$ Pa. In FIG. 18, curves 220, 222, 224 and 226 show cases where the lower layer 56C has the thickness t2 of 5 μm, 10 μm, 30 μm (which corresponds to the embodiment shown in FIGS. 9A to 9C), and 50 μm, respectively. Other parameters are the same with the above-described embodiment.

If the thickness t2 of the lower layer 56C is greater than the thickness t1 of the upper layer 56B (if the relationship t1<t2 is satisfied in such a manner that the thickness of the layer having the low coefficient of linear expansion is greater than the thickness of the layer having the high coefficient of linear expansion, in other words, in the cases of the curves 224 and 226 in FIG. 18, which include the diaphragm 56 according to the present embodiment), the relationship between the elasticity coefficient E1 of the upper layer 56B ($2.0\times10^{11}$ Pa) and the elasticity coefficient E2 of the lower layer 56C is desirably E1>E2.

According to FIG. 18, in the cases of the curves 224 and 226, which satisfy the condition of the lower layer 56C having the greater thickness t2 than the thickness t1 of the upper layer 56B (where the thickness t2 of the lower layer 56C is 30 μm or 50 μm), the maximum point of the amount of displacement of the supply flow channel 54A is located in the region where the elasticity coefficient E1 of the upper layer 56B ($2.0\times10^{11}$ Pa) is greater than the elasticity coefficient E2 of the lower layer 56C. Therefore, the material of the lower layer 56C is selected in such a manner that this maximum value is achieved. However, if the ratio of the elasticity coefficient E1 of the upper layer 56B with respect to the elasticity coefficient E2 of the lower layer 56C exceeds 1000 (in other words, if the condition E1/E2>1000 is satisfied), then the amount of change becomes 5 μm or less, and hence an effective amount of change is not obtained.

Consequently, when the relationship between the thickness t1 of the upper layer 56B and the thickness t2 of the lower layer 56C is t1<t2, then it is preferable that the elasticity coefficient E1 of the upper layer 56B and the elasticity coefficient E2 of the lower layer 56C satisfy the relationships E1>E2 and E1/E2≦1000.

As shown with the curve 222 in FIG. 18, if the thickness t2 of the lower layer 56C is substantially the same as the thickness t1 of the upper layer 56B (namely, t1≈t2≈10 μm), then it is desirable that the elasticity coefficient E1 of the upper layer 56B is substantially the same as the elasticity coefficient E2 of the lower layer 56C (E1≈E2). According to FIG. 18, on the curve 222, the displacement of the supply flow channel 54A has a maximum point in the region where the elasticity coefficient E2 of the lower layer 56C is in the vicinity of the elasticity coefficient E1 of the upper layer 56B ($2.0\times10^{11}$ Pa).

As shown with the curve 220 in FIG. 18, if the thickness t2 of the lower layer 56C is smaller than the thickness t1 of the upper layer 56B (namely, t1>t2), then it is desirable that the elasticity coefficient E1 of the upper layer 56B and the elasticity coefficient E2 of the lower layer 56C satisfy the relationship, E1<E2.

According to FIG. 18, in the case of the curve 220, which satisfies the condition of the lower layer 56C having the smaller thickness t2 than the thickness t1 of the upper layer 56B (where the thickness t2 of the lower layer 56C is 5 μm), the maximum point of the amount of displacement of the supply flow channel 54A is reached when the relationship E1<E2 is satisfied (where E2≈$1.0\times10^{12}$ Pa), in other words, the elasticity coefficient E2 of the lower layer 56C is greater than the elasticity coefficient E1 of the upper layer 56B ($2.0\times10^{11}$ Pa), and therefore, the material of the lower layer 56C is selected in such a manner that this maximum value is achieved. However, if the ratio of the elasticity coefficient E2 of the lower layer 56C with respect to the elasticity coefficient E1 of the upper layer 56B exceeds 1000 (in other words, if the condition E2/E1>1000 is satisfied), then the amount of change becomes 5 μm or less, and hence an effective amount of change is not obtained.

Consequently, when the relationship between the thickness t1 of the upper layer 56B and the thickness t2 of the lower layer 56C is t1≧t2, then it is preferable that the elasticity coefficient E1 of the upper layer 56B and the elasticity coefficient E2 of the lower layer 56C satisfy the relationships E1≦E2 and E2/E1≦1000.

If the ratio between the elasticity coefficient E1 of the upper layer 56B and the elasticity coefficient E2 of the lower layer 56C is extreme as over 1000 or under 1/1000, then the change in the cross-sectional area of the supply flow channel 54A (in other words, the amount of displacement of the tongue section 56A of the diaphragm 56) becomes small, namely, 5 μm or less. In other words, in the present embodiment, if the elasticity coefficient of the resin material used in the lower layer 56C is very small, then the tongue section 56A does not distort or deform, and the difference in the linear expansions between the upper layer 56B and the lower layer 56C is absorbed by the elastic deformation of the lower layer 56C. Moreover, if the elasticity coefficient of the resin material used in the lower layer 56C is very high, then the tongue section 56A has high rigidity and undergoes little deformation.

In the inkjet recording apparatus 10 having the composition described above, the diaphragm 56 has the two-layer structure formed of the materials of different coefficients of linear expansion, and the tongue section 56A provided in the diaphragm 56 is disposed so as to cover a portion of the supply port 54, through which ink is supplied to the pressure chamber 52 from the common liquid chamber 55, and hence the tongue section 56A forms a portion of the supply flow channel 54A. The tongue section 56A deforms in accordance with change in the temperature of the ink, thereby changing the size (cross-sectional area) of the supply flow channel 54A, and therefore it is possible to suppress variation in the ejection characteristics caused by change in the ink viscosity due to change in the ink temperature, by means of the simple structure. Furthermore, it is not necessary to provide sensors for measuring the ink temperature, or a system for controlling the ink temperature in accordance with temperature change, or a system for controlling the drive waveform for the actuators 58. Therefore, the composition of the inkjet recording apparatus 10 can be simplified.

The aforementioned embodiments are described with respect to an inkjet recording apparatus used for color printing by means of a plurality of colors of ink, but the present invention may also be applied to an inkjet recording apparatus used for monochrome printing.

Moreover, in the foregoing explanation, an inkjet recording apparatus is described as one embodiment of an image forming apparatus, but the scope of application of the present invention is not limited to this. For example, the drive apparatus of a liquid ejection head, and the liquid ejection apparatus according to the present invention may also be applied to a photographic image forming apparatus in which developing solution is applied to a printing paper by means of a non-contact method. Furthermore, the scope of application of the driving apparatus for a liquid ejection head and the liquid ejection apparatus according to the present invention is not limited to an image forming apparatus, and the present invention may also be applied to various other types of apparatuses which spray a processing liquid, or other liquid, toward an ejection receiving medium by means of a liquid ejection head (such as a coating device, wiring pattern printing device, or the like).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a pressure chamber which accommodates liquid to be ejected through an ejection aperture;

a diaphragm which constitutes a wall of the pressure chamber;

a supply port which is formed as an opening section in a portion of the diaphragm;

a supply flow channel which is provided between the supply port and the pressure chamber; and a common liquid chamber which accommodates the liquid to be supplied to the pressure chamber through the supply port and the supply flow channel and is arranged on a side of the diaphragm reverse to a side thereof adjacent to the pressure chamber, wherein the diaphragm has a tongue section, a portion of a perimeter of the tongue section being surrounded by the supply port, the tongue section constituting a portion of a wall of the supply flow channel, a portion of the diaphragm forming the tongue section having a laminated structure of an upper layer on the side adjacent to the common liquid chamber and a lower layer on the side adjacent to the pressure chamber, a coefficient of linear expansion $\alpha 1$ of the upper layer and a coefficient of linear expansion $\alpha 2$ of the lower layer satisfying a relationship of $\alpha 1 < \alpha 2$, at least a portion of the tongue section being bendable in a direction to change a size of the supply flow channel.

2. The liquid ejection head as defined in claim 1, wherein the diaphragm has a laminated structure of an upper layer on the side adjacent to the common liquid chamber having the coefficient of linear expansion $\alpha 1$ and a lower layer on the side adjacent to the pressure chamber having the coefficient of linear expansion $\alpha 2$.

3. The liquid ejection head as defined in claim 1, wherein the supply port has a substantially horseshoe-shaped planar form when observed from the side of the common liquid chamber.

4. The liquid ejection head as defined in claim 1, wherein the coefficient of linear expansion $\alpha 1$ of the upper layer and the coefficient of linear expansion $\alpha 2$ of the lower layer satisfy a relationship of $\alpha 2/\alpha 1 > 6$.

5. The liquid ejection head as defined in of claim 1, wherein:

a thickness t1 of the upper layer and a thickness t2 of the lower layer satisfy a relationship of $t1 \geqq t2$; and an elasticity coefficient E1 of the upper layer and an elasticity coefficient E2 of the lower layer satisfy a relationship of $E1 \leqq E2$.

6. The liquid ejection head as defined in of claim 1, wherein:

a thickness t1 of the upper layer and a thickness t2 of the lower layer satisfy a relationship of $t1 < t2$; and an elasticity coefficient E1 of the upper layer and an elasticity coefficient E2 of the lower layer satisfy a relationship of $E1 > E2$.

* * * * *